US007860420B2

(12) United States Patent
Mochizuki

(10) Patent No.: US 7,860,420 B2
(45) Date of Patent: Dec. 28, 2010

(54) CLEANER-LESS IMAGE FORMING APPARATUS

(75) Inventor: Jun Mochizuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 833 days.

(21) Appl. No.: 11/566,375

(22) Filed: Dec. 4, 2006

(65) Prior Publication Data

US 2007/0127944 A1 Jun. 7, 2007

(30) Foreign Application Priority Data

Dec. 5, 2005 (JP) ..... 2005-351364

(51) Int. Cl.
*G03G 15/00* (2006.01)

(52) U.S. Cl. ..... 399/71

(58) Field of Classification Search ..... 399/71, 399/101, 149, 297
See application file for complete search history.

(56) References Cited

U.S. PATENT DOCUMENTS

| | | | | |
|---|---|---|---|---|
| 5,678,142 | A | 10/1997 | Saegusa | 399/129 |
| 5,940,661 | A | 8/1999 | Yagi et al. | 399/174 |
| 6,289,186 | B1 * | 9/2001 | Ohshima | 399/75 |
| 6,385,428 | B1 * | 5/2002 | Uchida et al. | 399/101 |
| 6,603,941 | B2 | 8/2003 | Watanabe et al. | 399/129 |
| 2001/0048821 | A1 * | 12/2001 | Tomizawa et al. | 399/149 |
| 2003/0049048 | A1 * | 3/2003 | Yoshikawa et al. | 399/129 |

FOREIGN PATENT DOCUMENTS

| | | |
|---|---|---|
| JP | 8-190269 | 7/1996 |
| JP | 10-288934 | 10/1998 |
| JP | 2002-99176 | 4/2002 |
| JP | 2002-311692 | 10/2002 |
| JP | 2003-162182 | 6/2003 |
| JP | 2004-21951 | 1/2004 |

* cited by examiner

*Primary Examiner*—David M Gray
*Assistant Examiner*—Gregory H Curran
(74) *Attorney, Agent, or Firm*—Fitzpatrick, Cella, Harper & Scinto

(57) ABSTRACT

An image forming apparatus includes an image bearing member; charging means for applying electric charge to toner; a developing device; an intermediary transfer member; a primary transfer member for transferring the toner image from the image bearing member onto the intermediary transfer member; a secondary transfer member for transferring the toner image from the intermediary transfer member onto a recording material; and toner collecting means for collecting the toner remaining on the intermediary transfer member. The apparatus is operable in a collecting mode in which a voltage is applied to the primary transfer member during one full rotation of the image bearing member in a period of non-toner-image-formation such that absolute value of a current through the primary transfer member is larger than an absolute value of a current through the primary transfer member at the time of primary transfer of the toner image.

5 Claims, 15 Drawing Sheets

CLEANER-LESS IMAGE FORMING APPARATUS

FIELD OF THE INVENTION AND RELATED ART

The present invention relates to an electrophotographic image forming apparatus, in particular, an electrophotographic image forming apparatus which cleans its image bearing member in the development area at the same time as it develops a latent image on the image bearing member.

There is a cleaner-less electrophotographic image forming apparatus, that is, an electrophotographic image forming apparatus which does not have a cleaning apparatus dedicated to cleaning. In this type of electrostatic latent image forming apparatus, the toner remaining on the peripheral surface of the photosensitive member after toner image transfer is removed from the peripheral surface of the photosensitive member by the developing apparatus. That is, the residual toner is removed from the peripheral surface of the photosensitive member by a developing apparatus, in the development area at the same time as a latent image on the photosensitive is developed by the developing apparatus ("cleaning by developing means").

Japanese Laid-open Patent Application 2002-99176 discloses an example of "cleaning by developing means". According to this patent application, first, the toner (transfer residual toner) remaining on the peripheral surface of the photosensitive member is charged by a charging member to a bias which is the same in polarity as the toner in the developing device.

After being charged by the charging member to the same polarity as the toner in the developing device, the residual toner is collected into the developing apparatus by the fog bias, which is the difference in potential level (Vback) between the DC voltage applied to the developing apparatus and the surface potential of the photosensitive member. With the presence of this fog removal bias, the transfer residual toner, on the areas (points) of the peripheral surface of the photosensitive member, which are not to be developed by toner, is collected into the developing apparatus. This cleaning method makes it unnecessary to provide an electrophotographic image forming apparatus with a cleaning apparatus dedicated to cleaning, being therefore advantageous from the standpoint of reducing the size of an electrophotographic image forming apparatus.

However, some of the toner particles in the transfer residual toner fail to be normally charged when the bias, which is the same in polarity as the toner in the developing device is applicable. These toner particles occur due to the developer deterioration attributable to usage, the electric discharge at various areas of the peripheral surface of the photosensitive member, and/or the like. The toner particles which fail to be normally charged include the reversely charged toner particles, that is, the toner particles charged to the polarity opposite to the normal toner polarity, and undercharged toner particles, that is, the toner particles insufficient in the amount of charge compared to the properly charged toner particles.

More specifically, "undercharged toner" means toner, the electric charge of which is no more than −10 μc/g when the amount of the electric charge of the properly charged toner is roughly −10--30 μc/g. The particle distribution curve of under charged toner, in terms of the amount of electric charge, is continuous. The toner particles which failed to be normally charged are inferior in collectability, failing thereby to be collected into the developing apparatus. As they fail to be collected, they remain on the peripheral surface of the photosensitive member as the photosensitive member is rotated. Thus, they cause the photosensitive member to be unsatisfactorily charged and/or exposed. Further, they sometimes become welded to the peripheral surface of the photosensitive member, causing thereby the formation of an unsatisfactory image.

As one of the countermeasures for the above-described problems, more specifically, one of the methods for effectively removing the reversely charged toner particles on the peripheral surface of the photosensitive member, it has been proposed to apply such a bias that is opposite in polarity to the bias applied to the transfer belt during the normal image forming operation, to the transfer belt, in order to transfer the reversely charged toner particles onto the transfer belt (for example, Japanese Laid-open Patent Application 2003-162182).

However, the method disclosed in Japanese Laid-open Patent Application 2003-162182 leaves the undercharged toner particles on the peripheral surface of the photosensitive member. As the countermeasure for this problem, Japanese Laid-open Patent Application 2002-99176 proposes to increase the voltage applied to a charge amount controlling means when charging the transfer residual toner. This countermeasure, however, overcharges the transfer residual toner, making it difficult to properly clean a photosensitive member by a developing apparatus, in the development area, at the same time as a latent image on the photosensitive member is developed by the developing apparatus. In addition, increasing the voltage applied to the charge amount controlling means sometimes causes toner particles to adhere to the charge amount controlling means, while charging the transfer residual toner, making it difficult to properly charge the photosensitive member during the subsequent image forming operations.

SUMMARY OF THE INVENTION

The primary object of the present invention is to provide an image forming apparatus, the image bearing member(s) of which is simultaneously cleaned, in the development area, while a latent image on the image bearing member(s) is developed, and which is characterized in that the undercharged toner particles are fully removed to prevent the formation of a defective image, the defects of which are attributable to the problem that the image bearing member fails to be satisfactorily charged due to the presence of the undercharged transfer residual toner particles on the image bearing member, the problem that the photosensitive member fails to be properly exposed due to the presence of the undercharged transfer residual toner particles on the image bearing member, the problem that the transfer residual toner particles adhere to the image bearing member, and/or the like.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
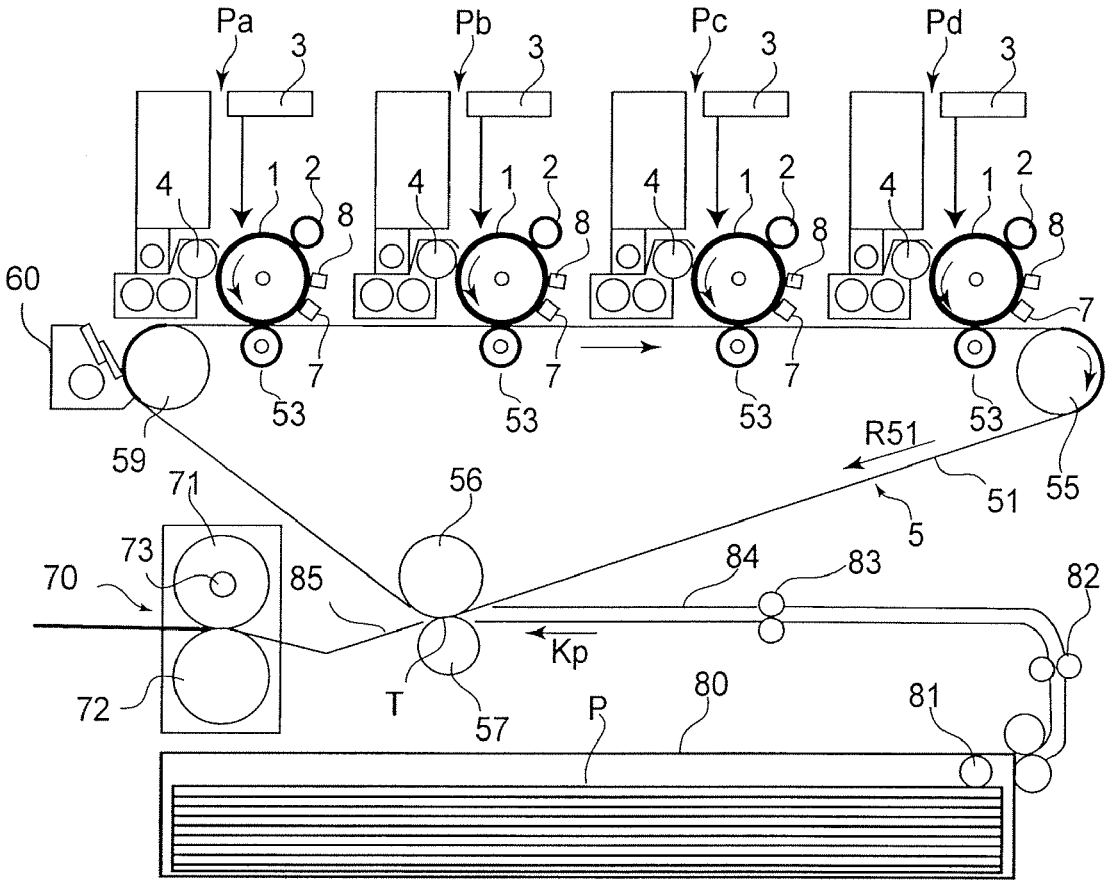
FIG. 1 is a schematic drawing of the image forming apparatus in the first and second embodiments of the present invention, showing the general structure thereof.

Hereinafter, the preferred embodiments of the present invention will be described with reference to the appended drawings. Incidentally, a given component in any of the appended drawings is designed by a reference character which is the same as the one by which another component in the same drawing or another drawing, the two components are the same in structure and/or function. Therefore, once one of the two components is described, the other will not be described to avoid the repetition of the same description.

Embodiment 1

Shown in FIG. 1 is an image forming apparatus to which the present invention is applicable. The image forming apparatus in FIG. 1 is a cleaner-less electrophotographic forming apparatus, which employs an intermediary transferring means. It is a full-color image forming apparatus based on four primary colors, and has four image bearing members. FIG. 1 is a schematic vertical sectional view of the image forming apparatus, at a plane parallel to the front side of the image forming apparatus, on which a user is when the user operates the image forming apparatus.

Next, referring to FIG. 1, the structure and operations of the image forming apparatus will be described.

The image forming apparatus shown in FIG. 1 is provided with four process units Pa, Pb, Pc, and Pd which form yellow, magenta, cyan, and black images (images formed of toner), respectively. The four toner images, which are different in color and formed by the process units Pa, Pb, Pc, and Pd, respectively, are sequentially transferred (primary transfer) onto an intermediary transfer belt 51 as an intermediary transferring member (member to which toner images are temporarily transferred), in the primary transfer area. Thereafter, the toner images are transferred (secondary transfer) all at once onto a recording medium P, such as a sheet of paper, in the secondary transfer area.

Each of the above-mentioned process units Pa, Pb, Pc, and Pd is provided with a photosensitive drum 1 (image bearing member). Each process unit is also provided with a primary charge roller 2 (primary charging means), an exposing apparatus 3 (electrostatic latent image forming means), a developing apparatus 4 (developing means), a primary transfer roller 53, etc., which are arranged in the adjacencies of the peripheral surface of the photosensitive drum 1 in the listed order, in terms of the rotational direction (indicated by arrow mark in FIG. 1) of the photosensitive drum 1.

Next, referring to FIG. 2, the structure of the process unit Pa will be described. The structures of the three other process units Pb, Pc, and Pd are the same as that of the process unit Pa. Therefore, they are not going to be described.

(a) Photosensitive Drum

Figure 2:
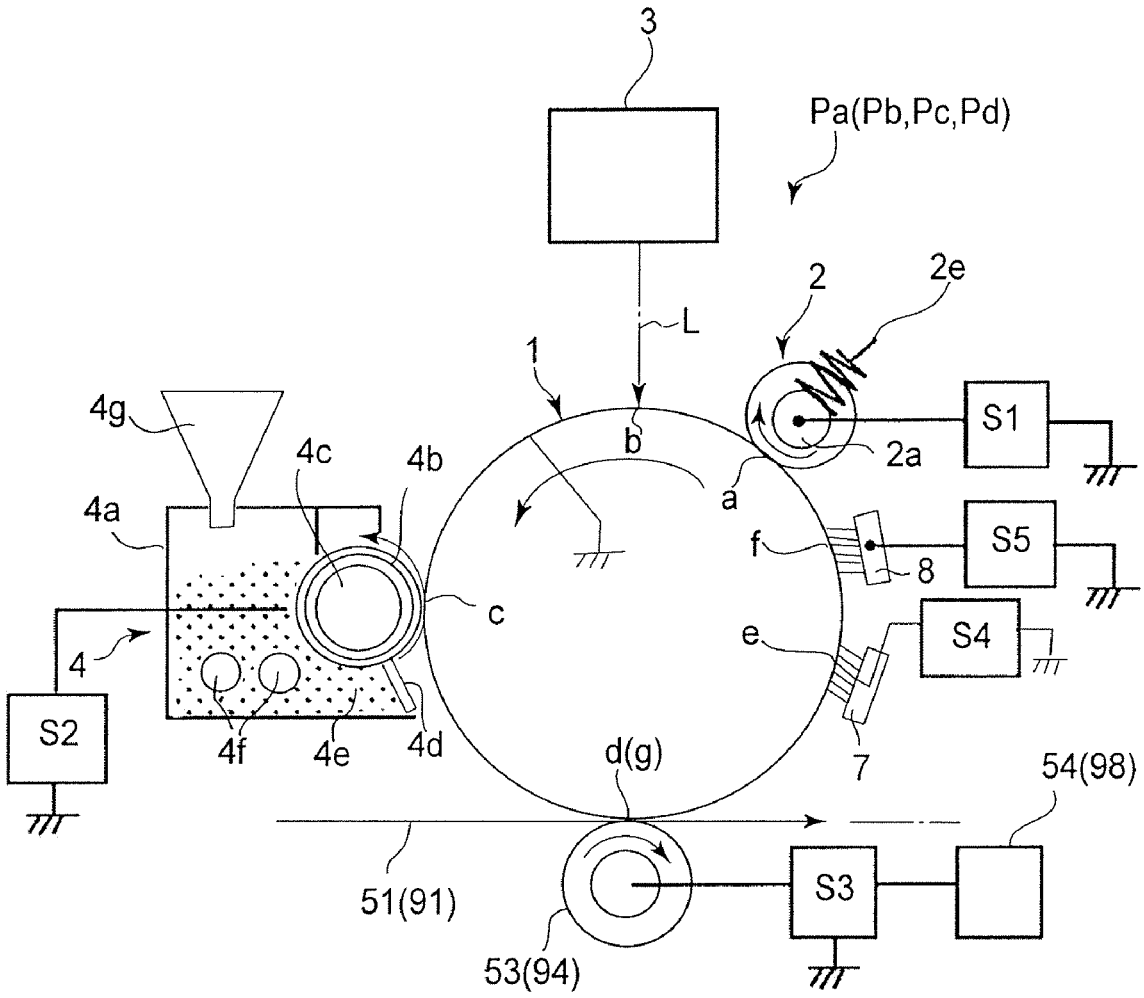
FIG. 2 is a schematic drawing of the process unit, showing the general structure thereof.
Figure 3:
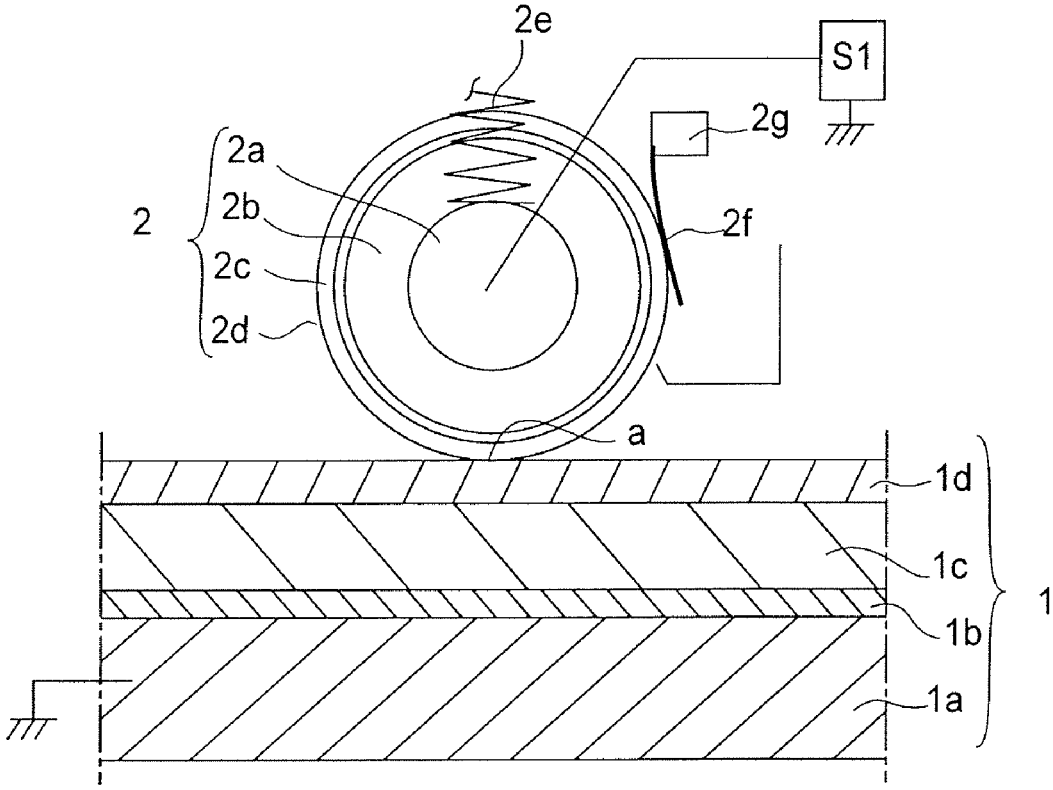
FIG. 3 is a schematic drawing of the photosensitive drum and charge roller, showing the laminar structures thereof.

Referring to FIG. 2, in this embodiment, an electrophotographic photosensitive member 1, which is in the form of a drum (photosensitive drum) is employed as an image bearing member. FIG. 3 schematically shows the laminar structures of the photosensitive drum 1 and charge roller 2. As will be evident from FIG. 3, the photosensitive drum 1 is made up of an electrically conductive substrate 1*a* in the form of a drum (aluminum cylinder, for example), an undercoat layer 1*b* coated on the peripheral surface of the substrate 1*a* to suppress optical interference and improve the substrate 1*a* in the fastness of the bond between the substrate 1*a* and the functional layers laminated to the peripheral surface of the substrate 1*a*. The photosensitive drum 1 is also provided with a layer of an organic photoconductor (OPC) coated on the peripheral surface of the undercoat layer 1*b*. The OPC is negative in terms of the normal polarity to which it is chargeable. The OPC layer is made up of a photoelectric charge generation layer 1*c*, which is a mid layer, and a charge transfer layer 1*d*, which is the outermost layer. The overall diameter of the photosensitive drum 1 is 30 mm. The photosensitive drum 1 is rotationally driven by a driving means (not shown) about its rotational axis, at a process speed (peripheral velocity) of 100 mm/sec, in the direction (counterclockwise direction) indicated by an arrow mark in FIG. 2.

(b) Charge Roller

Referring to FIG. 3, in this embodiment, the charge roller 2 is used as the charging means for charging the peripheral surface of the photosensitive drum 1 to preset polarity and potential level. The charge roller 2 is 320 mm in length. FIG. 3 shows the laminar structure of the charge roller 2. The charge roller 2 is made up of a metallic core 2*a* (supporting portion), and three functional layers, that is, an under layer 2*b*, an intermediary layer 2*c*, and a surface layer 2*d*, which are laminated on the peripheral surface of the metallic core 2 in the listed order. The under layer 2*b* is formed of sponge (foamed substance) for minimizing the charge roller 2 in charging noises, and the intermediary layer 2*c* is an electrically conductive layer for rendering the entirety of the charge roller 2 uniform in electric resistance. The surface layer 2*d* is a protective layer provided for preventing electrical leak, even if the photosensitive drum 1 has defects, such as pinholes. The above-mentioned metallic core 2*a* is a piece of stainless steel rod, which is 6 mm in diameter. The under layer 2*b* is formed of foamed EPDM, in which carbon has been dispersed. The under layer 2*b* is 0.5 g/cm$^3$ in specific gravity, $10^2$-$10^6$ Ω·cm in volume resistivity, 700 μm in thickness. The surface layer 2*d* is formed of Toresin, which is a fluorinated chemical compound, in which tin oxide, and carbon have been dispersed. It is $10^7$-$10^{10}$ Ω·cm in volume resistivity, 1.5 μm in surface roughness (JIS: ten point average surface roughness Ra), and 10 μm in thickness.

As shown in FIG. 3, there is a charge roller cleaning member 2*f*, which is placed in contact with the charge roller 2, and is formed of flexible cleaning film. The charge roller cleaning member 2*f* is placed in parallel with the lengthwise direction of the charge roller 2, and is attached, by one of its long edges, to a supporting member 2*g* which is enabled to shuttle a preset distance in the same lengthwise direction. Further, the charge roller cleaning member 2*f* is disposed so that its surface adjacent to the other long edges, that is, the free long edge, is placed in contact with the peripheral surface of the charge roller 2 to form a contact nip between the charge roller 2 and the peripheral surface of the charge roller 2. The supporting member 2*g* is enabled to shuttle the preset distance in the lengthwise direction of the charge roller 2, by a motor (not shown) of the printer, through a gear train. Thus, as the motor is activated, the surface layer 2*d* of the charge roller 2 is rubbed by the charge roller cleaning member 2*f*, being thereby cleared of adherent contaminants (microscopic toner particles, additives, etc.).

The charge roller 2 is rotatably supported at the lengthwise end portions of its metallic core 2*a* by a pair of bearings (not shown), one for one, which are kept pressed toward the photosensitive drum 1 by a pair of compression springs 2*e*. Thus, the charge roller 2 is kept pressed upon the peripheral surface of the photosensitive drum 1 by a preset amount of pressure generated by the pair of compression springs 2*e*. Therefore, as the photosensitive drum 1 is rotated in the direction (counterclockwise direction) indicated by the arrow mark in the drawing, the charge roller 2 is rotated by the rotation of the photosensitive drum 1 in the direction (clockwise direction) indicated by another arrow mark in the drawing. The contact area between the photosensitive drum 1 and charge roller 2 constitutes the charging area a (charging location).

As charge bias voltage, which satisfies preset conditions, is applied to the metallic core 2*a* of the charge roller 2 from an electric power source S1, the charge roller 2 uniformly charges the peripheral surface of the rotating photosensitive drum 1 to preset polarity and potential level. In this embodiment, the charge bias voltage applied to the charge roller 2 is an oscillatory voltage, which is a combination of DC voltage (Vdc) and AC voltage (Vac). More specifically, the DC voltage is −600 V, and the AC voltage is 1,000 Hz in frequency, 1,400 V in peak-to-peak voltage (Vpp), and sinusoidal in waveform. As this charge bias voltage, that is, the combination of the DC and AC voltages, is applied to the charge roller 2, the peripheral surface of the photosensitive drum 1 is uniformly charged to −600 V (Vd: voltage of unexposed point) by the charge roller 2 which is placed in contact with the peripheral surface of the photosensitive drum 1.

(c) Exposing Apparatus

Referring to FIG. 2, the exposing apparatus 3, as an information writing means, for forming an electrostatic latent image on the peripheral surface of the photosensitive drum 1 after the charging of the photosensitive drum 1 is disposed as shown in FIG. 2. In this embodiment, a laser beam scanner made up of a semiconductor laser is employed. The exposing apparatus 3 scans (exposes) the charged area of the peripheral surface of the photosensitive drum 1, with the beam of laser light L it outputs while modulating it with the picture signals sent to the image forming apparatus from a host apparatus, such as an image reading apparatus (not shown) or the like (exposing apparatus 3 selectively exposes numerous points of charged area of peripheral surface of photosensitive drum), in the exposing area b (exposing location). This scanning of the charged area of the peripheral surface of the photosensitive drum 1 by the exposing apparatus 3 selectively reduces in potential the numerous points of the charge area of the peripheral surface of the photosensitive drum 1, effecting thereby an electrostatic latent image, which reflects the picture information, on the peripheral surface of the photosensitive drum 1.

(d) Developing Apparatus

Also referring to FIG. 2, the process unit Pa is provided with the developing apparatus 4 (developing device), as a developing means, which develops an electrostatic latent image on the photosensitive drum 1 into a visible image by supplying the electrostatic latent image with developer (toner). In this embodiment, a reversal developing apparatus, which uses a developing method based on a two-component magnetic brush, is employed as the developing apparatus 4.

The developing apparatus 4 has a developing means container 4*a*, and a nonmagnetic development sleeve 4*b*. This development sleeve 4*b* is rotatably disposed in the developing means container 4*a*, with the peripheral surface of the development sleeve 4*b* partially exposed from the developing means container 4*a*. The development sleeve 4*b* is provided with a magnetic roll 4*c*, which is solidly anchored in the internal space of the development sleeve 4*b*. The developing apparatus 4 is also provided with a developer coating blade 4*d*, a developer stirring member 4*f*, and a toner hopper 4*g*. The developer stirring member 4*f* is located in the bottom portion of the internal space of the developing means container 4*a*.

The developing means container 4*a* contains two-component developer 4*e* (which hereafter may be referred to simply as developer, as fits), which is a mixture, the main components of which are toner and magnetic carrier. The developer 4*e* is stirred by the developer stirring member 4*f*. The magnetic carrier is roughly $10^{13}$ Ω·cm in resistance, and roughly 40 μm in particle diameter. The toner is negatively charged by the friction between the toner and magnetic carrier.

The development sleeve 4*b* is disposed in the developing means container 4*a* so that its peripheral surface opposes the peripheral surface of the photosensitive drum 1, with the presence of a minimum gap of (S-Dgap) of 350 μm between the peripheral surfaces of the development sleeve 4*b* and photosensitive drum 1. The point at which the distance between the peripheral surfaces of the development sleeve 4*b* and photosensitive drum 1 is 350 μm, and its adjacencies, constitutes the development area c. The development sleeve 4*b* is rotationally driven so that the moving direction (advancing direction) of the peripheral surface of the development sleeve 4*b* in the development area c is opposite to the moving direction (advancing direction) of the peripheral surface of the photosensitive drum 1 in the development area c. A part of the body of two-component developer 4*e* in the developing means container 4*a* is adhered to the peripheral surface of the development sleeve 4*b* by the magnetic force of the magnetic roll 4*c*, and is retained as a magnetic brush layer on the peripheral surface of the development sleeve 4*b* by the magnetic force. As the development sleeve 4*b* is rotated, the two-component developer 4*e* on the peripheral surface of the development sleeve 4*b* moves between the developer coating blade 4*b* and the peripheral surface of the development sleeve 4*b*, while being formed into a thin layer of two-component developer 4*e* with a preset thickness. As the development sleeve 4*b* is rotated further, the thin layer of developer 4*e* on the peripheral surface of the development sleeve 4*b* is moved through the development area c, in which the thin layer of the developer 4*e* comes into contact with the peripheral surface of the peripheral surface of the development sleeve 4*b* and rubs against the peripheral surface of the development sleeve 4*b* in the preset manner. To the development sleeve 4*b*, a preset development bias is applied from an electric power source S2. In this embodiment, the development bias voltage applied to the development sleeve 4*b* is an oscillatory voltage, which is the combination of the DC voltage Vdc and AC voltage Vac. More specifically, the DC voltage Vdc is −450 V, and the AC voltage Vac is 1,600 V in peak-to-peak voltage.

As the development sleeve 4*b* is rotated, the developer 4*e* in the developing means container 4*a* is borne on the development sleeve 4*b*, is formed into a thin layer of the developer 4*e* by the developer coating blade 4*d*, and is conveyed to the development area c. In the development area c, the toner in the thin layer of developer 4*e* is adhered to the numerous points of the peripheral surface of the photosensitive drum 1, in the pattern of the electrostatic latent image on the peripheral surface of the photosensitive drum 1. In this embodiment, the toner is adhered to the exposed points of the electrostatic latent image on the peripheral surface of the photosensitive drum 1. In other words, the electrostatic latent image is developed in reverse. The portion of the developer on the development sleeve 4*b*, which has moved past the development area c, is returned to the developer reservoir in the developing means container 4*a*, by the further rotation of the development sleeve 4*b*.

In order to keep the toner content of the two-component developer 4*e* in the developing means container 4*a* roughly in the preset range, the toner content of the two-component developer 4*e* in the developing means container 4*a* is detected by an optical toner content sensor (not shown), for example. Based on the information provided by the toner content sensor, the driving of the toner hopper 4*g* is controlled so that the toner in the toner hopper 4*g* is supplied to the two-component developer 4*e* in the developing means container 4*a*. As the toner is supplied to the two-component developer 4*e* in the developing means container 4*a*, it is stirred by the stirring member 4*f*.

(e) Intermediary Transfer Unit

Referring to FIG. 1, the intermediary transfer unit 5 as a transferring means is disposed so that it is below each of the photosensitive drums 1 of the process units Pa, Pb, Pc, and Pd. The intermediary transfer unit 5 has an intermediary transfer belt 51, four primary transfer rollers 53 (primary transferring members), an intermediary transfer belt driving roller 55, a secondary transfer roller 56 (disposed within loop which intermediary transfer belt 51 forms), a secondary transfer roller 57 (disposed outside loop which intermediary transfer belt 51 forms), a tension roller 59, an intermediary transfer belt cleaner 60 (toner collecting member), etc.

The intermediary transfer belt 51 is made by forming dielectric resin into an endless belt. In this embodiment, a sheet of PI resin, which is $10^9$ Ω·cm in volume resistivity (measured with the use of a probe in compliance with JIS-K9611, while applying 100 V for 60 seconds, at 23° C. in temperature and 60% in RH), and 90 μm in thickness t, was used as the material for the intermediary transfer belt 51. However, the material for the intermediary transfer belt 51 does not need to be limited to the above-mentioned one. That is, any substance may be used as the material for the intermediary transfer belt 51, as long as the volume resistivity of the substance is in a range of $10^8$-$10^{12}$ Ω·cm when 100 V is applied. The thickness, etc., of the material does not matter.

The primary transfer roller 53 is made up of a metallic core, which is 8 mm in diameter, and a cylindrical electrically conductive layer of urethane sponge, which covers the peripheral surface of the metallic core. The electrical resistance of the primary transfer roller 53 is obtained from the amount of electric current measured while rotating the primary transfer roller 53 at a peripheral velocity of 50 mm/sec and applying a voltage of 100 V to the metallic core, with the primary transfer roller 53 kept pressed upon a grounded metallic roller with the application of 500 g of load. The thus obtained electrical resistance of the primary roller 53 was roughly $10^5$Ω (23 C. in temperature and 60% in RH). To the primary transfer roller 53, +200 V of transfer bias is applied from an electric power source S3 as will be described later. As the transfer bias is applied to the primary transfer roller 53, the toner image on the photosensitive drum 1 is transferred (primary transfer) onto the intermediary transfer belt 51, in the transfer area d. Incidentally, the transfer bias which the electric power source S3 applies to the transfer roller 53 is controlled by a controlling means 54.

(f) Fixing Apparatus

A fixing apparatus 70 as a fixing means has a rotatable fixation roller 71, a pressure roller 72, and a heater 73, etc. The pressure roller 72 rotates while being pressed upon the fixation roller 71. The heater 73 is a halogen lamp or the like, and is disposed in the hollow of the fixation roller 71. The surface temperature of the fixation roller 71 of the fixing apparatus 70 is controlled by controlling the voltage applied to the heater 73.

The image formation (image forming operation) by the above-described image forming apparatus is as follows: Multiple toner images different in color are sequentially formed on the photosensitive drums 1, one for one, and are sequentially transferred (primary transfer) onto the intermediary transfer belt 51. Then, the toner images are conveyed to the secondary transfer area T by the rotation of the intermediary transfer belt 51. Meanwhile the recording medium P is picked out of a sheet feeder cassette 80 by a pickup roller 81, and is fed into the main assembly of the image forming apparatus by the pickup roller 81. Then, by the time the toner images on the intermediary transfer belt 51 reach the secondary transfer area T, the recording medium P is delivered to the second transfer area T by a pair of conveyer rollers 82 and a pair of conveyer rollers 83, in the direction indicated by an arrow mark Kp, while being guided by a pre-transfer sheet conveyance guide 84. In the secondary transfer area T, the toner images are transferred onto the recording medium P by the secondary transfer bias applied between the internal secondary transfer roller 56 and external secondary transfer roller 57. The transfer residual toner, that is, the toner remaining on the intermediary transfer belt 51 after the secondary image transfer, is removed and collected by the intermediary transfer belt cleaner 60.

Then, the recording medium P is separated from the intermediary transfer belt 51, and conveyed further to the fixing apparatus 70 along a post-transfer sheet conveyance guide 85. Then, the recording medium P is conveyed between the fixation roller 71 and pressure roller 72 of the fixing apparatus 70. While it is conveyed between the two rollers 71 and 72, the recording medium P and the toner images thereon are subjected to the roughly constant heat and pressure applied thereto from the top and bottom sides of the recording medium P. Therefore, the toners on the recording medium are welded to the surface of the recording medium P, ending the image forming operation for yielding a single one-sided full-color copy (formed of four primary color) of the intended image.

Next, the structure of the cleaner-less cleaning system in this embodiment will be described.

The image forming apparatus in this embodiment is a cleaner-less apparatus. That is, it does not have a means dedicated to the removal of the toner (transfer residual toner) remaining on the peripheral surface of each photosensitive drum 1 after the transfer of a toner image onto the intermediary transfer belt 51. Thus, the transfer residual toner on the peripheral surface of the photosensitive drum 1 is carried to the development area c by the rotation of the photosensitive drum 1, through the charging area a and exposing area b, in the subsequent image forming operations. Then, it is collected in the development area c by the developing apparatus 4 at the same time as a latent image is developed by the developing apparatus 4, in the development area c.

Since the transfer residual toner on the photosensitive drum 1 is moved through the exposing area b, the peripheral surface of the photosensitive drum 1 is exposed, with the transfer residual toner remaining on the peripheral surface of the photosensitive drum 1. However, the exposing process is not seriously affected, because the amount of transfer residual toner is very small. Incidentally, the transfer residual toner is the mixture of the normally charged toner particles, reversely charged toner particles (reverse polarity toner particles), and undercharged toner particles, as described above.

Figure 4:
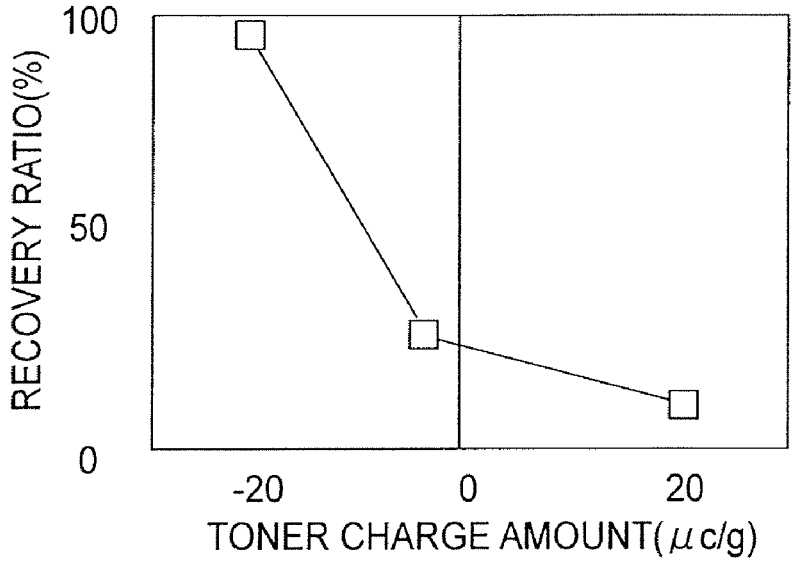
FIG. 4 is a graph showing the relationship between the amount of toner charge and the ratio at which the toner is collected by the developing apparatus.

The undercharged toner particles and reversely charged toner particles fail to be satisfactorily collected in the development area c by the developing apparatus 4 at the same time as the developing apparatus 4 develops a latent image in the development area c. FIG. 4 shows the relationship between the amount of toner charge and the toner collection ratio by the developing apparatus 4. In the drawing, the horizontal axis represents the amount of toner charge, and the vertical axis represents the toner collection ratio (weight ratio) of the developing apparatus 4. As will be evident from FIG. 4, the negatively charged toner particles, that is, the normally charged toner particles, which were roughly −5 μc/g in the amount of electric charge, were almost 100% in collection ratio, whereas the undercharged toner particles, which were roughly 5 μc/g in the amount of electric charge, and the reversely charged toner particles, which were roughly 20 μc/g in the amount of electric charge, were no more than 20%, in collection ratio, which is a drastically small value compared to the collection ratio of the normally charged toner particles.

Figure 5:
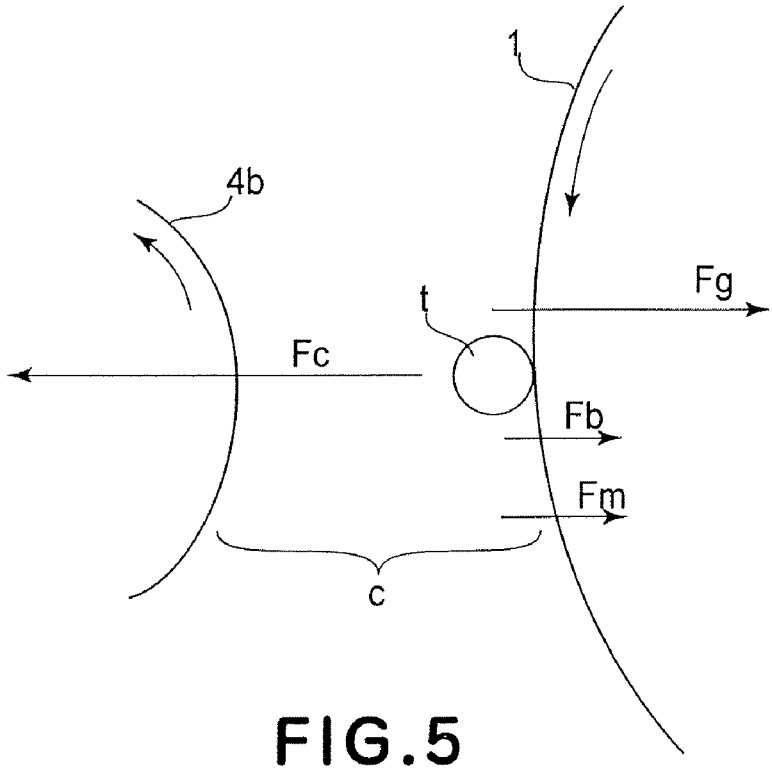
FIG. 5 is a schematic drawing of the development area, showing the force which acts on the normally charged toner particle in the development area.

The reason for the above-mentioned difference in collection ratio between the normally charged toner particles and abnormally charged toner particles are thought by the inventors of the present invention to be explainable from the relationship (difference) between the force which acts on the normally charged toner particles and the force which acts on the abnormally charged toner particles. FIG. 5 shows the various forces which act on the toner particles in the development area c. As the forces which act in the direction to attract a toner particle t to the peripheral surface of the photosensitive drum 1, there are a mirror image force Fg attributable to the electric charge of the toner particle t, a liquid bridging force Fb attributable to the contact between the toner particle t and the peripheral surface of the photosensitive drum 1, and an intermolecular force Fm. As the forces which act in the direction to pull the toner particle t away from the peripheral surface of the photosensitive drum 1, there is a Coulomb force Fc attributable to the development electric field of the developing apparatus 4. When the toner particle t is normal in both the polarity and amount of electric charge, the Coulomb force Fc=qE (q stands for amount of electric charge of toner particle t, and E stands for magnitude of electric field of development area c), which is attributable to the difference (fog removal potential) between the surface potential (−600 V) of the photosensitive drum 1 and the potential (−450 V) of the development sleeve 4*b*. This force acts in the direction to move the toner particle t away from the peripheral surface of the photosensitive drum 1 toward the development sleeve 4*b*. Thus, the toner particles t is collected by the development sleeve 4*b* when this force exceeds the sum of the mirror image force Fg, liquid bridging force Fb, and intermolecular force Fm.

Figure 6:
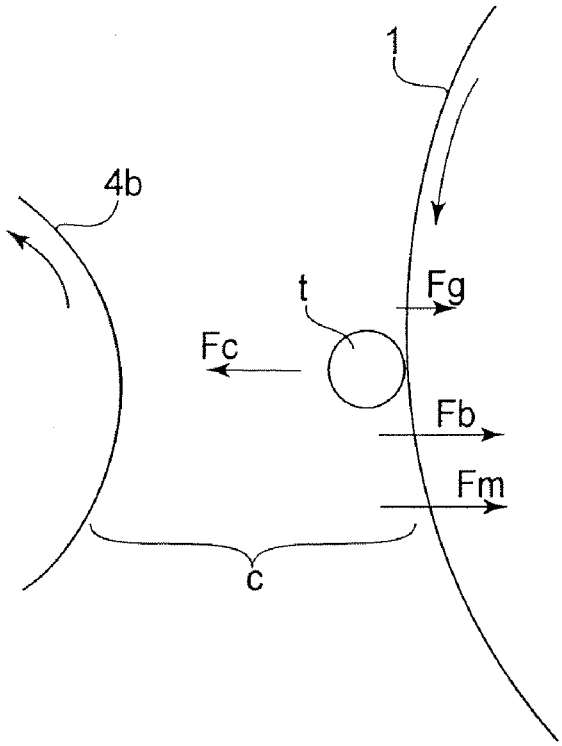
FIG. 6 is a schematic drawing of the development area, showing the force which acts on the undercharged toner particle in the development area.

However, when the toner particle t is in sufficient in the amount of electric charge, it is insufficient in the amount of Coulomb force which acts thereon, because it is insufficient in the amount of electric charge. Thus, the sum of the liquid bridging force Fb and intermolecular force Fm is larger than the mirror image force Fg, in terms of the ratio relative to the total amount of force which acts on the toner particle t, as shown in FIG. 6. In other words, the sum of the mirror image force Fg, liquid bridging force Fb, and intermolecular force Fm exceeds the Coulomb force Fc, preventing the undercharged toner particle t from being ejected from the peripheral surface of the photosensitive drum 1. Therefore, when the toner particle t is insufficient in the amount of electric charge, it moves through the development area c.

Figure 7:
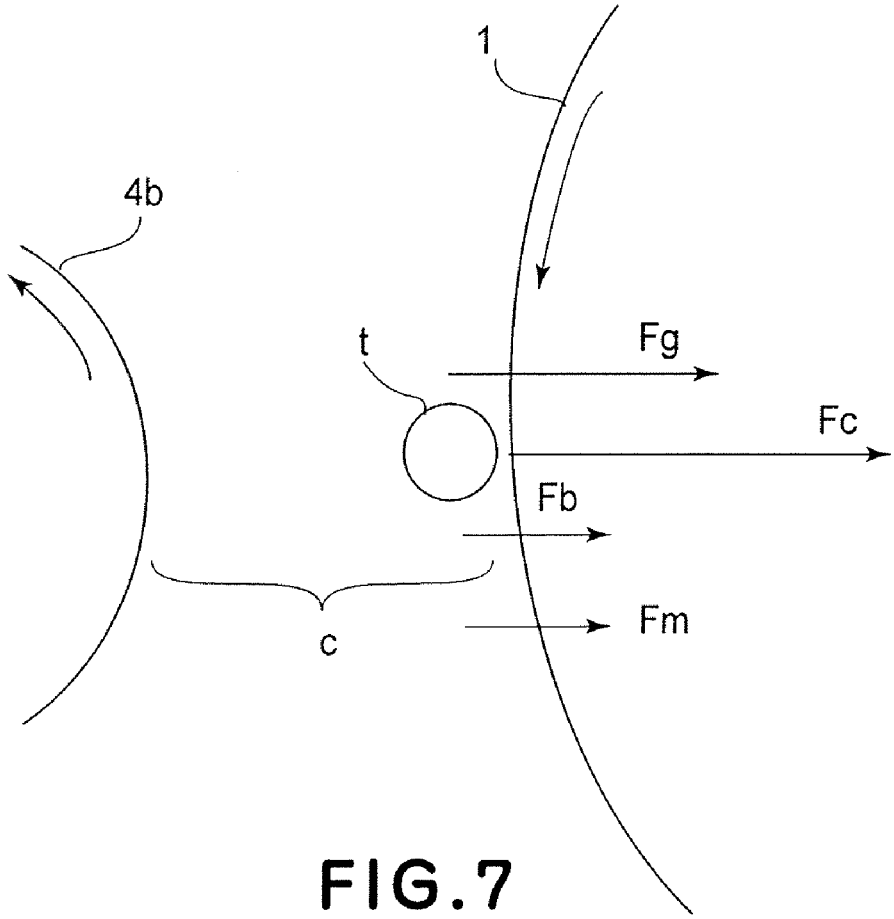
FIG. 7 is a schematic drawing of the development area, showing the force which acts on the reversely charged toner particle in the development area.

Next, referring to FIG. 7, when the toner particle t is reversely charged, the Coulomb force Fc acts in the opposite direction (direction to move toner particle toward photosensitive drum 1), because the toner particle t is opposite in polarity. In other words, all the forces that act on the toner particle t, that is, the mirror image force Fg, liquid bridging force Fb, intermolecular force Fm, and Coulomb force Fc, act in the direction to move the toner particle t toward the peripheral surface of the photosensitive drum 1. Therefore, when the toner particle t is reversely charged, it is not ejected from the peripheral surface of the photosensitive drum 1, and therefore, moves through the development area c.

In reality, however, some of the undercharged toner particles and reversely charged toner particles are collected by the developing apparatus 4 for a mechanical reason, that is, because the magnetic brush, that is, the thin layer of two-component developer, on the peripheral surface of the photosensitive drum 1, rubs against the peripheral surface of the photosensitive drum 1. The ratio at which the undercharged toner particles are collected for this reason is thought to be no more than 25%.

The toner particles, such as those described above, which are not collected by the developing apparatus 4 remain stuck on the peripheral surface of the photosensitive drum 1, accumulating thereon, as the photosensitive drum 1 is continuously rotated. Thus, as the cumulative usage of the image forming apparatus increases, the amount of these toner particles remaining on the peripheral surface of the photosensitive drum 1 becomes substantial, not only causing the peripheral surface of the photosensitive drum 1 to be unsatisfactorily charged, and/or unsatisfactorily exposed, but also, welding themselves to the peripheral surface of the photosensitive drum 1. In other words, these toner particles cause the image forming apparatus to form an unsatisfactory image.

In this embodiment, therefore, the cleaner-less image forming apparatus is provided with two innovative structural arrangements for controlling the occurrence of the undercharged toner particles and reversely charged toner particles. Hereafter, the two structural arrangements will be described in detail.

(A) Structural Arrangement for Transferring Means

The transfer residual toner contains toner particles, which are close to zero in the amount of electric charge, and toner particles which are reverse in polarity, as described above. Thus, in order to minimize the amount by which these toner particles are effected, the image forming apparatus in this embodiment is structured to minimize the electric discharge in the transfer area d.

Figure 8:
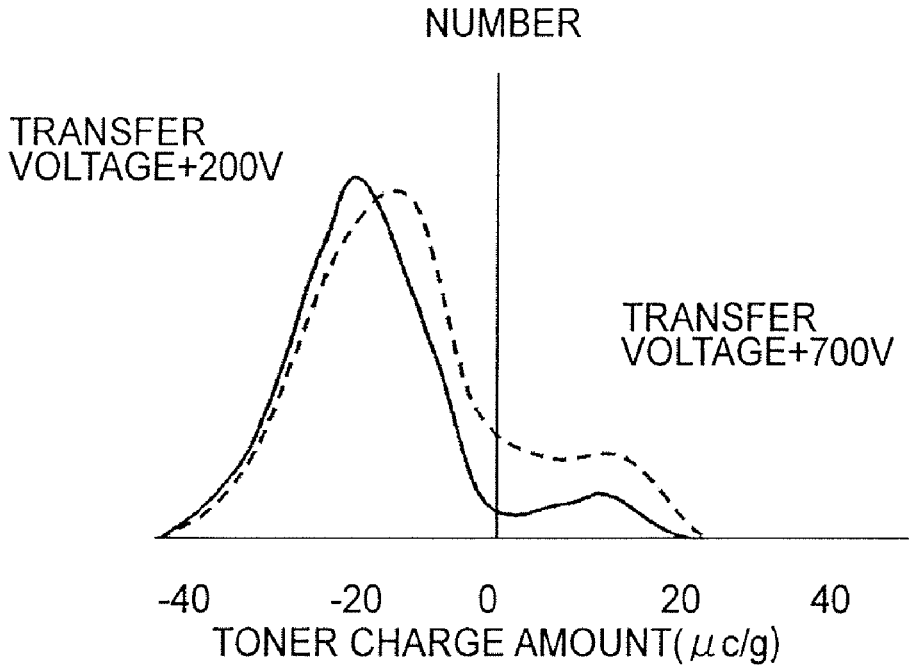
FIG. 8 is a graph showing the particle distribution of the transfer residual toner, in terms of the amount of electric charge, when the transfer voltage is +200 V, and when the transfer voltage is +700 V.

The studies made by the inventors of the present invention revealed that there is a correlation between the amount of the undercharged toner particles and reversely charged (positively charged) toner particles, and the setting of the transfer bias. FIG. 8 shows the particle distributions of the transfer residual toner, in terms of electric charge, when the transfer bias applied to the primary transfer roller 53 was +200 V and when it was +700 V. In FIG. 8, the horizontal axis represents the amount of electric charge, and the vertical axis represents the number of toner particles (occurrence probability). As will be evident from the graph, the undercharged toner particles and reversely charged (positively charged) toner particles were effected whether the transfer bias (transfer voltage) was set to +200 V or +700 V. However, when the transfer bias was set to +200 V, or the lower value, the amount of the undercharged toner particles and reversely charged toner particles was smaller than when the transfer bias was set to +700 V, or the higher value. This proves that setting the transfer bias as low as possible is effective to minimize the amounts by which the undercharged toner particles and reversely charged toner particles are effected.

Figure 9:
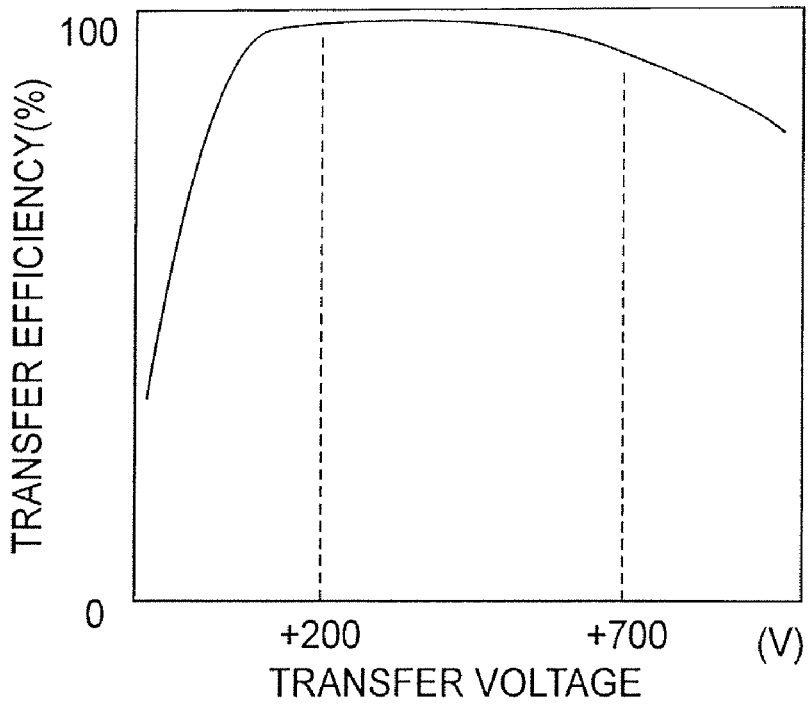
FIG. 9 is a graph showing the relationship between the transfer voltage and transfer efficiency.

On the other hand, the transfer bias must be set to make the toner transfer efficiency as high as possible. Therefore, how low the transfer bias can be set is regulated by the desired level of transfer efficiency. FIG. 9 shows the relationship between the transfer bias (transfer voltage) and transfer efficiency. In FIG. 9, the horizontal axis represents the transfer bias (transfer voltage), and the vertical axis represents the transfer efficiency (weight ratio of toner which transferred from photosensitive drum 1 onto intermediary transfer belt 51). As will be evident from FIG. 9, up to where the transfer voltage was roughly +100 V, the higher the transfer voltage, the higher the transfer efficiency. Where the transfer voltage was roughly 140 V or higher, the transfer efficiency remained roughly the same up to where it began to reduce. As the transfer voltage was increased further, the transfer efficiency was reduced.

In this embodiment, therefore, in order to minimize the amount by which the undercharged toner particles and reversely charged toner particles are affected, the transfer bias was set as low as possible, within a range in which the transfer efficiency was satisfactory. More specifically, +200 V was selected as the optimal transfer bias value for the cleaner-less image forming apparatus in this embodiment. In this case, however, a small amount of reversely charged (positively charged) toner particles was found in the transfer residual toner, as shown in FIG. 4.

(B) Charge Controlling Means

In this embodiment, therefore, in order to make all the toner particles in the transfer residual toner negatively charged, that is, normally charged in polarity, the process unit Pa is provided with first and second toner (developer) charge controlling means (charging means) 7 and 8, as shown in FIG. 2. In terms of the rotational direction of the photosensitive drum 1, the toner charge controlling means 7 and 8 are disposed on the downstream side of the transfer area, and on the upstream side of the charging area a. Further, the first toner charge controlling means 7 is on the upstream side of the second toner charge controlling means 8.

In this embodiment, the first and second toner charge controlling means 7 and 8 are in the form of a brush, the actual electrical resistance of which is in a range of $10^5$-$10^7\Omega$. They are 5 mm in brush width and 4 mm in brush length, and are disposed in contact with the peripheral surface of the photosensitive drum 1. To the first toner charge controlling means 7, positive voltage is applied from an electric power source S4, and to the second toner charge controlling means 8, negative voltage is applied from an electric power source S5.

Referring to FIG. 2, designated by a referential symbol e is the contact area (contact location) between the photosensitive drum 1 and first toner charge controlling means 7. The negatively charged toner particles in the transfer residual toner which is the mixture of toner particles different in the amount of electric charge as well as polarity, are temporarily trapped in the contact area e by the positive voltage applied to the first toner charge controlling means 7. Then, they are positively charged by the positive voltage applied to the first toner charge controlling means 7. Then, they escape from the contact area e little by little by adhering to the peripheral surface of the photosensitive drum 1, and are conveyed further. As for the toner particles which were positively charged immediately after they moved through the transfer area d, and the undercharged toner particles, most of them are not captured by the first toner charge controlling means 7; they move through the contact area e. Thus, the toner particles which came out of the downstream side of the contact area e of the first toner charge controlling means are mostly undercharged toner particles and positively charged toner particles.

Figure 10:
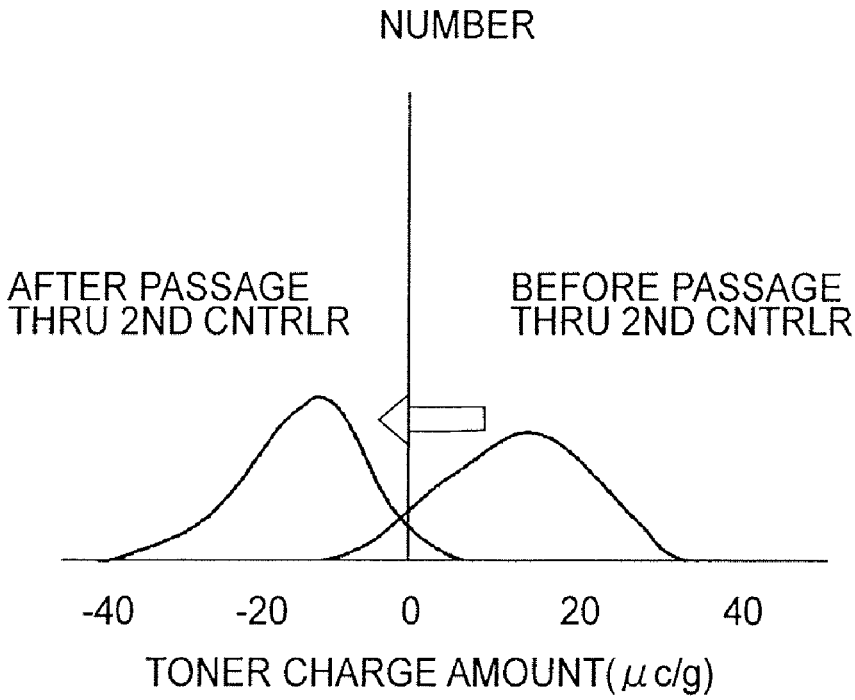
FIG. 10 is a graph showing the difference in the amount of electric charge of the residual toner between before and after the residual toner is moved through the second toner charge controlling means.

Also referring to FIG. 2, designated by a referential symbol f is the contact area (contact position) between the photosensitive drum 1 and second toner charge controlling means 8. The positively charged toner particles, among the undercharged or positively charged toner particles which came out of the downstream end of the contact area e of the first toner charge controlling means 7, are temporarily trapped in the contact area f by the negative voltage applied to the second toner charge controlling means 8. Further, the positively charged toner particles in the transfer residual toner are negatively charged by the positive voltage applied to the second toner charge controlling means 8. Then, they escape from the contact area f little by little by adhering to the peripheral surface of the photosensitive drum 1, and are conveyed further. FIG. 10 shows the difference in the amount of electric charge of the toner particles on the peripheral surface of the photosensitive drum 1 between before and after the toner particles were moved through the contact area f of the toner charge controlling means 8. It is evident from FIG. 10 that before the transfer residual toner particles were moved through the contact area f of the second toner charge controlling means 8, they were undercharged or positively charged, whereas after they were moved through the contact area f, they were negatively charged. The first toner charge controlling means 7 made all the toner particles on the peripheral surface of the photosensitive drum 1 the same in polarity (in that all are positive charged), making it easier for the second toner charge controlling means 8 to capture all the toner particles on the peripheral surface of the photosensitive drum 1 to make all the toner particles the same in polarity (in that they are negatively charged).

Thus, after the transfer residual toner particles are moved through the second toner charge controlling means 8, they all are negatively charged, that is, normally charged in terms of polarity. Therefore, they are conveyed to the development area b, without adhering to the charge roller 2, which is on the downstream side of the second toner charge controlling means 8, and to which negative voltage is being applied. Then, they are collected in the developing apparatus 4 and are used for the subsequent image forming operations.

However, the studies made by the inventors of the present invention revealed that as the length of time the toner charge controlling means 7 and 8, which in this embodiment are in the form of a brush, increases, a substantial amount of toner collects among the bristles of the toner charge controlling means 7 and 8, reducing the controlling means in the ability to temporarily capture toner particles and charge them.

Figure 11:
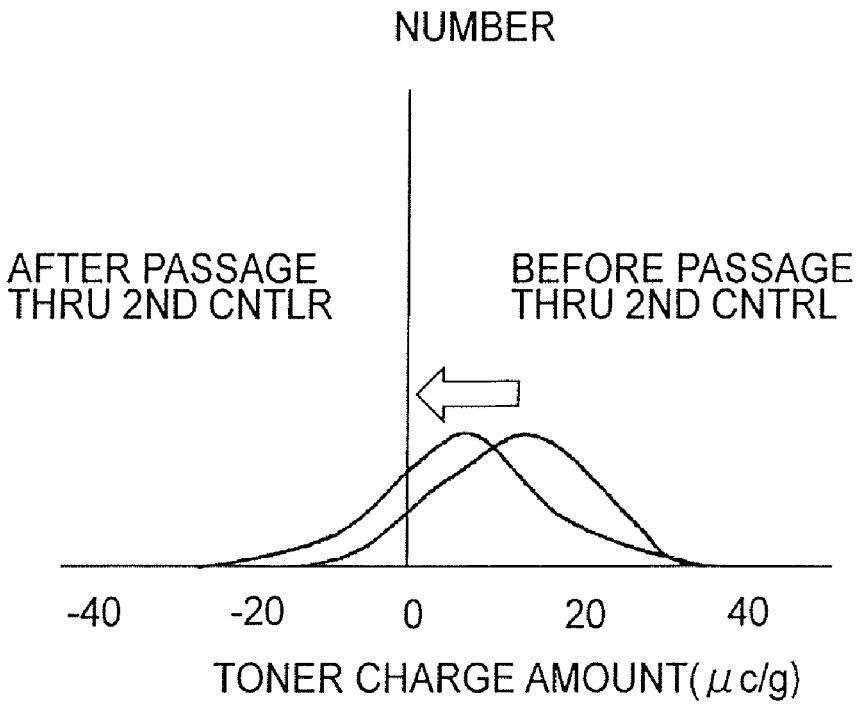
FIG. 11 is a graph showing the difference in the amount of electric charge of the toner having deteriorated in performance due to usage and/or elapse of time, between before and after the toner is moved through the second toner charge controlling means.

FIG. 11 shows the difference in the amount of electric charge of the transfer residual toner particles between before and after the transfer residual toner particles were moved through the second toner charge controlling means 8, the performance of which had been reduced due to an elapse of time. From the comparison of the toner particle distribution, in terms of amount of electric charge, in FIG. 11, to that in FIG. 10, it is evident that, in terms of the amount of the undercharged toner particles, that is, the toner particles, the amount of electric charge of which are close to zero, after the transfer residual toner was moved through the area f of the second toner charge controlling means 8, the amount when the second toner charge controlling means 8 was lower in performance was greater than the amount when the second toner charge controlling means 8 was normal in performance. This seems to have occurred for the following reason. That is, as toner particles collected in a brush (in the spaces among the bristles of a brush), they reduced the brush in the ability to capture toner particles, allowing therefore some toner particles to move though the contact area between the brush and peripheral surface of the photosensitive drum 1 without being recharged. These toner particles were not collected by the developing apparatus 4. This is why the undercharged or reversely charged toner particles accumulated on the peripheral surface of the photosensitive drum 1 and were carried around thereon.

In order to remove the toner particles which moved through the contact area f of the second toner charge controlling means 8 and remained stuck on the peripheral surface of the photosensitive drum 1, the inventors of the present invention applied to the primary transfer roller 53 such a bias that was opposite in polarity to the normal bias applied to the primary transfer roller 53. This method was effective to remove the reversely charged toner particles, but, was not effective to remove the undercharged toner particles.

Figure 12:
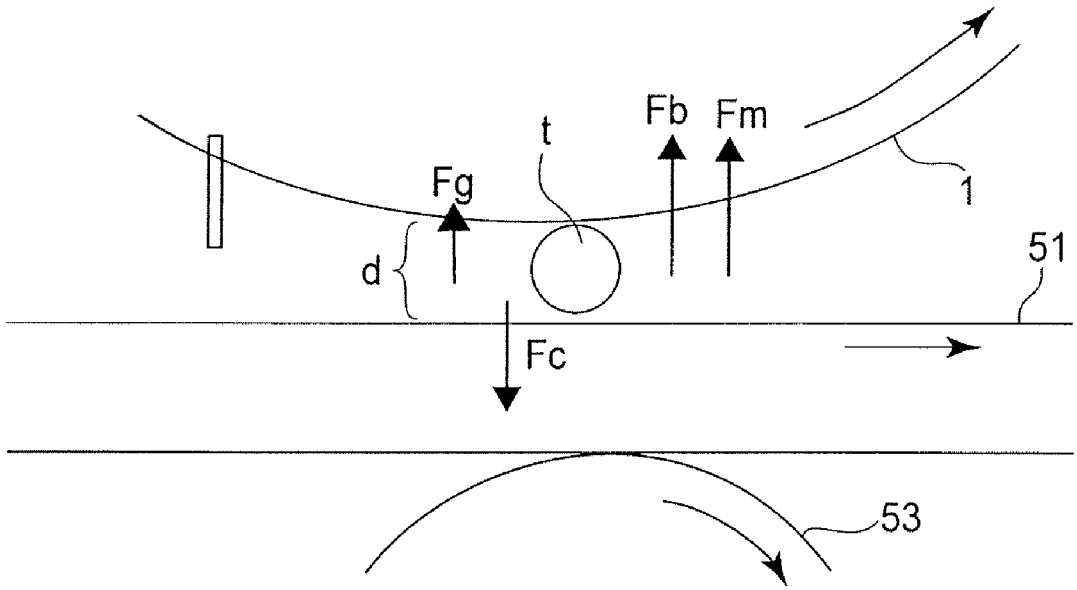
FIG. 12 is a schematic drawing of the development area, showing the condition under which the undercharged toner particle is difficult to remove.

To contemplate on the above-mentioned results, referring to FIG. 12, it is reasonable to think that when the toner particle t is undercharged, the liquid bridging force Fb between the toner particle t and photosensitive drum 1, and intermolecular force Fm, overwhelm the Coulomb force Fc. As a measure for increasing the Coulomb force Fc under the above-described condition, it is possible to strengthen the transfer electric field. For example, if the amount of the charge of the toner particle t is ⅕ the normal amount, it is necessary to quintuplicate the strength of the transfer electric field, in order to make the Coulomb force Fc as strong as when the toner particle t is normal in the amount of charge. Therefore, a high voltage power source with an extremely high output is required.

In this embodiment, therefore, a method of removing the undercharged toner particles after recharging them using the primary transfer roller 53 is employed. That is, the undercharged toner particles are recharged so that they can be removed by the transfer electric field. This method recharges the toner particle t using the primary transfer roller 53, being therefore different from the above-described method which uses the toner charge controlling means 7 and 8, in that the reduction in charging performance attributable to the continuation of an image forming apparatus does not occur. Therefore, the method used in this embodiment can extremely reliably remove the undercharged toner particles.

Next, the details of the cleaning mode for removing the undercharged toner particles, which characterizes this embodiment, will be described.

(1) The cleaning mode in this embodiment is carried out while the image forming apparatus is not used for a normal image forming operation. When the image forming apparatus is in the cleaning mode, a transfer bias which is larger than the normal transfer bias applied for image formation is applied to the primary transfer roller 53 to charge the undercharged toner particles to the polarity opposite to their polarity. Here, the larger transfer bias means a transfer bias greater, in terms of the absolute value of the electric current which flows through the primary transfer roller 53, than the normal transfer bias.

If a larger transfer bias is applied to the charge roller 2 or toner charge controlling means 7 and 8, toner particles adhere to the charge roller 2 or toner charge controlling means 7 and 8, making it difficult to properly charge the image bearing member during the subsequent image forming operations. In this embodiment, therefore, a transfer bias larger than the transfer bias applied for the normal image formation is applied only to the primary transfer roller 53, which is kept pressed upon the photosensitive drum 1 with the interposition of the intermediary transfer belt 51 provided with the intermediary transfer belt cleaner 60, between the primary transfer roller 51 and photosensitive drum 1.

As described above, in the cleaner-less image forming apparatus in this embodiment, the primary transfer bias was set as low as possible to prevent the occurrence of the undercharged or reversely charged toner particles. Further, the image forming apparatus is provided with the toner charge controlling means 7 and 8. With the employment of the measures, the cleaner-less image forming apparatus is substantially smaller in the amount of the undercharged or reversely charged toner particles remaining stuck on the peripheral surface of the photosensitive drum 1 than a cleaner-less image forming apparatus in accordance with the prior art.

However, it is possible that if an image forming operation is carried out by the cleaner-less image forming apparatus in this embodiment for a very long time, the amount of the undercharged or reversely charged toner particles which remain stuck on the peripheral surface of the photosensitive drum 1 will become substantial, causing thereby the image bearing member to be unsatisfactorily charged or unsatisfactorily exposed. It is also possible that the undercharged or reversely charged toner particles will weld themselves to the peripheral surface of the photosensitive drum 1. In this embodiment, therefore, the image forming apparatus is operated in the cleaning mode at preset intervals to remove the undercharged or reversely charged toner particles remaining stuck on the peripheral surface of the photosensitive drum 1.

Figure 13:
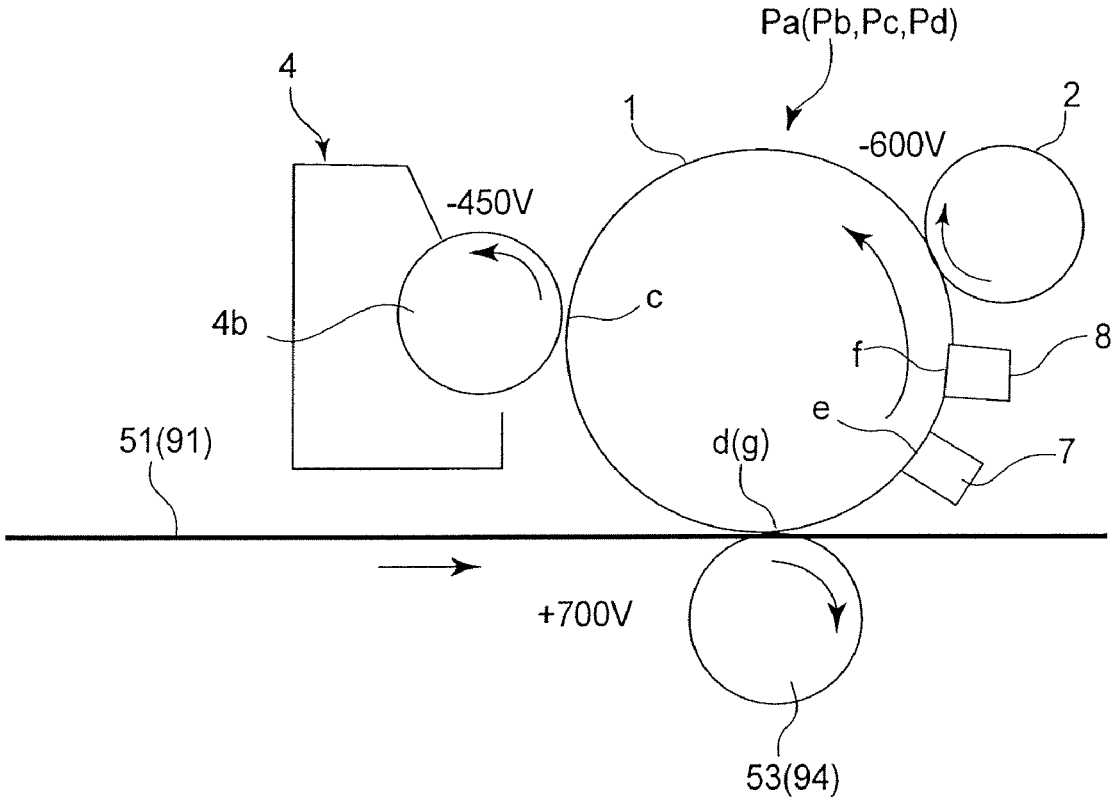
FIG. 13 is a schematic drawing of the process unit, showing the cleaning operation carried out the cleaning unit.
Figure 14:
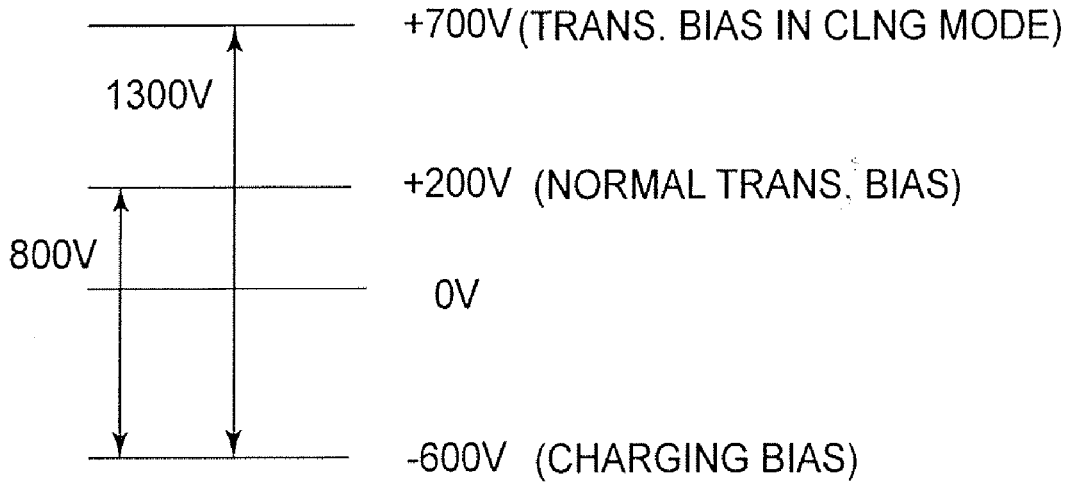
FIG. 14 is a schematic drawing describing the contrast bias (voltage).

Next, referring to FIG. 13, which shows the general structure of the process unit Pa (Pb, Pc, and Pd), the cleaning mode in this embodiment will be described. In the cleaning mode, first, the peripheral surface of the photosensitive drum 1 is uniformly charged to −600 V by the charge roller 2. The surface potential level to which the peripheral surface of the photosensitive drum 1 is charged in this step; increasing, in absolute value, the potential level to which the peripheral surface of the photosensitive drum 1 is to be charged in this step can increase the transfer contrast (which will be described later) in the transfer area d. In the cleaning mode, however, the uniformly charged area of the peripheral surface of the photosensitive drum 1 is not irradiated with a beam of laser light, while the uniformly charged area moves through the exposing area b. Then, while the uniformly charged area moves through the development area c, −450 V of DC voltage is applied as development bias to the development sleeve 4*b*. This bias is for preventing the magnetic carrier from adhering to the peripheral surface of the photosensitive drum 1. In this step, the development sleeve 4*b* does not need to be rotated. Next, while the uniformly charged area moves through the transfer area d, +700 V of DC voltage is applied as the first transfer bias to the transfer roller 53. Referring to FIG. 14, the amount by which the transfer current flows is determined by the contrast voltage (transfer contrast), which is the difference between the surface potential level of the photosensitive drum 1 and transfer bias. In this embodiment, the transfer contrast in the cleaning mode is 1,300 V (=700−(−600)). The amount of the electric current which flows through the primary transfer roller 53 when the image forming apparatus is operated in the cleaning mode is 15 μA in absolute value. In comparison, the transfer contrast in the normal image formation mode is 800 V (=200−(−600)). The amount of the electric current which flows through the primary transfer roller 53 when the image forming operation is operated in the normal image formation mode is 9 μA in absolute value.

Therefore, when the image forming apparatus is operated in the cleaning mode, electrical discharge occurs in the adjacencies of the transfer area d, and this electrical discharge charges the undercharged toner particles on the peripheral surface of the photosensitive drum 1 to the positive polarity.

Figure 15:
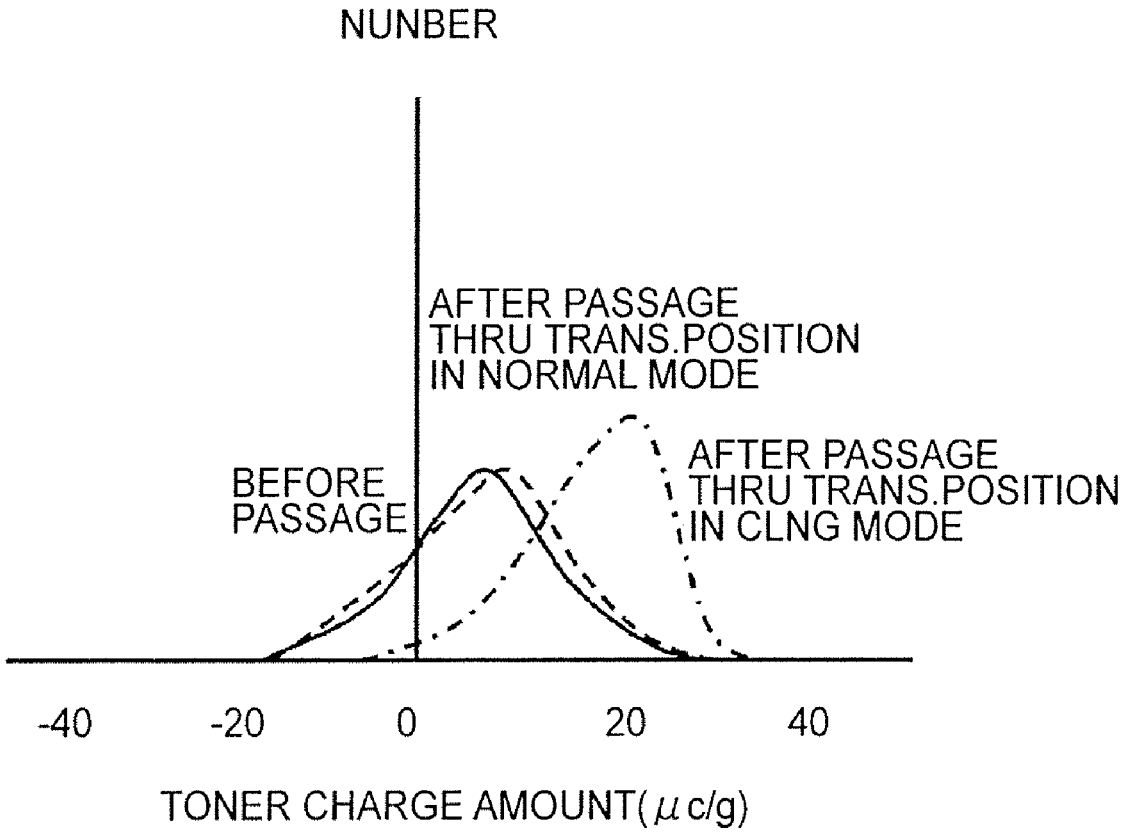
FIG. 15 is a graph showing the difference in the particle distribution of the transfer residual toner, in terms of the amount of electric charge, before and after the transfer residual toner is moved through the transfer area when the image forming apparatus is in normal mode and in a cleaning mode.

FIG. 15 shows the difference in the distribution of the toner particle, in terms of amount of charge, on the peripheral surface of the photosensitive drum 1, after the undercharged toner particles remaining stuck on the peripheral surface of the photosensitive drum were moved through the transfer area d, between when the transfer contrast was 800 V, that is, the normal transfer contrast, and when the transfer contrast was 1,300 V, that is, the transfer contrast in the cleaning mode in this embodiment. The solid line represents the distribution, in terms of the amount of charge, of toner particles remaining stuck on the peripheral surface of the photosensitive drum 1, indicating that a substantial amount of the undercharged toner particles, which are close to zero in electric charge, and a substantial amount of negatively toner particles, are present on the peripheral surface of the photosensitive drum 1. The broken line represents the distribution, in terms of the amount of electric charge, of the toner particles having stuck on the peripheral surface of the photosensitive drum 1, after they moved through the transfer area d, in which the transfer bias was normal, that is, 800 V. This distribution is not much different from that before the toner particles remaining stuck on the peripheral surface of the photosensitive drum 1 were moved through the transfer area d. For comparison, the toner particle distribution, in terms of the amount of charge, of the toner particles remaining stuck on the peripheral surface of the photosensitive drum 1, after they were moved through the transfer area d, in which the transfer contrast was 1,300 V, that is, the transfer contrast in the cleaning mode in this embodiment, is represented by the single-dot-broken line, which indicated that in this case, virtually all the toner particles were charged to the reverse polarity, that is, the positive polarity. As is evident from FIG. 15, in the cleaning mode in this embodiment, the undercharged toner particles on the peripheral surface of the photosensitive drum 1 are charged to the positive polarity by triggering electrical discharge in the adjacencies of the transfer area d by increasing the transfer contrast compared to the normal transfer contrast.

That is, when the cleaner-less image forming apparatus in this embodiment is operated in the above described cleaning mode, most of the undercharged toner particles having accumulated on the peripheral surface of the photosensitive drum 1 can be recharged by carrying out the above-described process for charging the toner particles on the peripheral surface of the photosensitive drum 1, for a length of time equivalent to no less than one full rotation of the photosensitive drum 1.

(2) The positively charged toner particles are transferred from the photosensitive drum 1 onto the intermediary transfer belt 51 by flowing a second transfer current, by applying a second transfer bias, which is opposite in direction from the first transfer bias, which is applied for the normal image formation.

Figure 16:
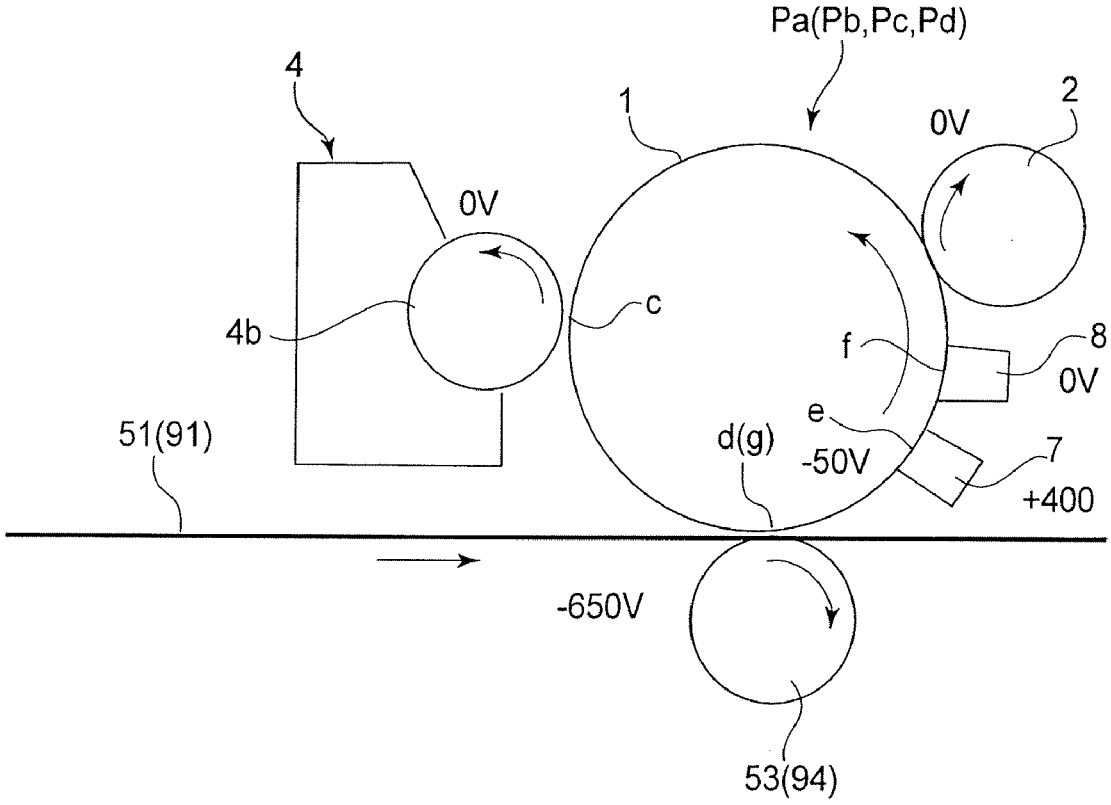
FIG. 16 is a schematic drawing of the process unit, showing the movements of the photosensitive drum and its adjacencies, in the cleaning mode.
Figure 17:
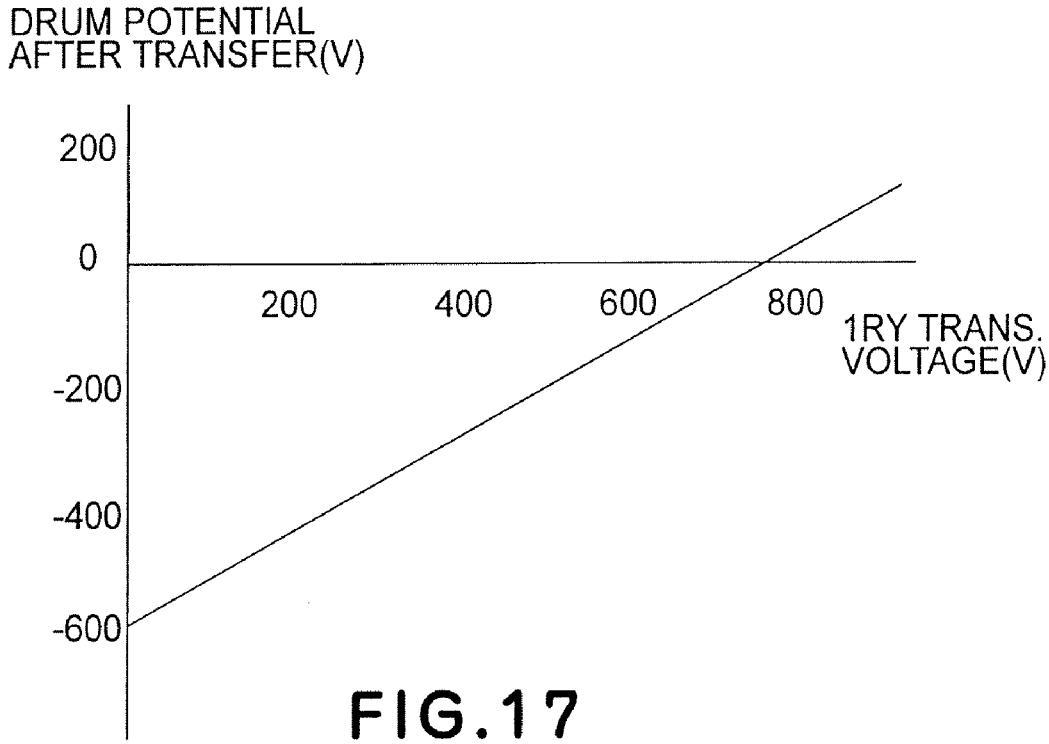
FIG. 17 is a graph showing the relationship between the primary transfer voltage and the surface potential of the photosensitive drum after the primary transfer.

More specifically, the positively charged toner particles, which were affected by the above-described process, are conveyed to the transfer area d for the second time by the subsequent rotation of the photosensitive drum 1. Next, referring to FIG. 16, what occurs to various portions of the process unit Pa (Pb, Pc, and Pd) while this process is carried out will be described. As a given area (first area) of the peripheral surface of the photosensitive drum 1 moves through the transfer area d, it is charged by the transfer contrast. Therefore, the potential level of area of the peripheral surface of the photosensitive drum 1 which has just moved through the transfer area d, is closer to the potential level of the transfer bias than it is to −600 V, which was its potential level before it was moved through the transfer area d. This means that the given area of the peripheral surface of the photosensitive drum 1 was charged (DC charge) by the transfer bias from the transfer roller 53. FIG. 17 shows the relationship between the voltage applied as the transfer bias, and the potential to which the potential of an area of the peripheral surface of the photosensitive drum 1 which has just been charged to −600 V changes as the area is moved through the transfer area d. According to FIG. 17, the higher the transfer bias, the higher in potential level the area of the peripheral surface of the photosensitive drum 1 after it is moved through the transfer area d. For example, if roughly +780 V is applied as the transfer bias, the potential level of the area of the peripheral surface of the photosensitive drum 1 which is −600 V in potential, will be roughly 0 V after the area is moved through the transfer area d. In this embodiment, +700 V of second transfer bias was applied, and the potential level of the area of the peripheral surface of the photosensitive drum 1 which was −600 V in potential, was roughly −50 V after the area was moved through the transfer area d.

Most of the toner particles on the peripheral surface of the photosensitive drum 1 are positively charged. Therefore, in order to prevent the positively charged toner particles from adhering to the various members of the process unit Pa due to the presence of the difference in potential level between the photosensitive drum 1 and the various members during the subsequent rotation of the photosensitive drum, the various members must be controlled in potential while the toner particles move through the adjacencies of the members. Referring to FIG. 16, in this embodiment, therefore, +400 V is applied to the first toner charge controlling means 7, which is on the downstream side of the transfer area d, but, no bias is applied to the second toner charge controlling means 8, charge roller 2, and development sleeve 4*b*. Thus, as the positively charged toner particles on the peripheral surface of the photosensitive drum 1 are moved by the rotation of the photosensitive drum 1 through the adjacencies of the various members of the process unit Pa, most of the positively charged toner particles reach the transfer area d for the second time. For the purpose of preventing, as described above, the positively charged toner particles on a given area of the peripheral surface of the photosensitive drum 1 from adhering to the various members of the process unit Pa, due to the presence of the difference in potential level between the area of the peripheral surface of the photosensitive drum 1 and the various members, while the area is moved through the adjacencies of the various members, it is desired that after the above-mentioned area of the peripheral surface of the photosensitive drum 1 is moved through the transfer area d, the area is the same (negative) in polarity as the charge bias applied to the charge roller 2 in the normal image formation mode. That is, if the potential of a given area of the peripheral surface of the photosensitive drum 1 is positive in polarity after it is moved through the transfer area d, positive bias must be applied to the charge roller 2 and development sleeve 4*b* to prevent the positively charged toner particles on the area from adhering to the charge roller 2 and development sleeve 4*b*. These biases are not required for the normal image formation. Therefore, the application of these biases requires the addition or modification of the high voltage power sources, which increases the cost for the high voltage power sources. Therefore, the upper limit in magnitude for the first transfer bias, that is, "the transfer bias greater in magnitude than the transfer bias applied for the normal image formation", which is to be applied to the transfer roller 53 in the cleaning mode in this embodiment, is set in consideration the relationship shown in FIG. 17.

Figure 18:
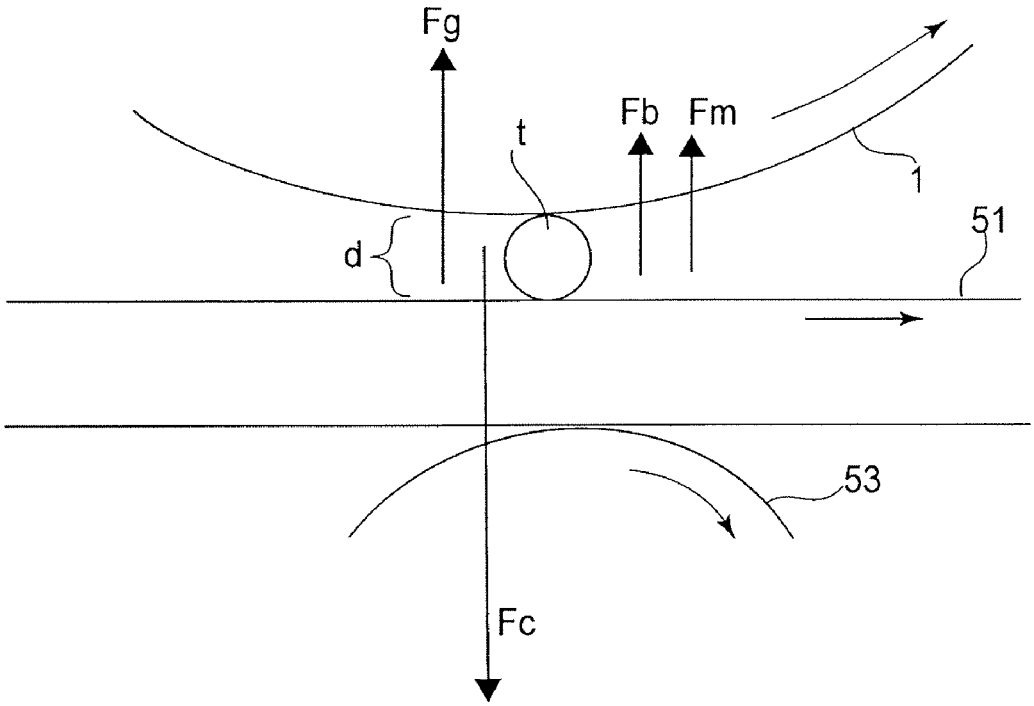
FIG. 18 is a schematic drawing of the development area, showing how and why the positively charged toner particle is transferred onto the transfer belt.

As described above, the positively charge toner particles on the peripheral surface of the photosensitive drum 1 are conveyed to the transfer area d and are moved through the transfer area d, by the rotation of the photosensitive drum 1. While these positively charged toner particles are moved through the transfer area d, −650 V is applied as the second transfer bias, which is opposite in polarity to the normal transfer bias, from the primary transfer roller 53, providing 700 V of transfer contrast. Therefore, the positively charged toner particles on the photosensitive drum 1 are transferred onto the intermediary transfer belt 51. To describe this process with reference to FIG. 18, the Coulomb force Fc which acts on the positively charged toner particle t, overwhelms the sum of the liquid bridging force Fb between the toner particle t and the photosensitive drum 1, intermolecular force Fm, and mirror image force Fg, causing thereby the positively charged toner t on the photosensitive drum 1 to transfer onto the intermediary transfer belt 51.

As described above, the second transfer bias, which is opposite in polarity to the normal transfer bias, is applied from the primary transfer roller 53 to the entirety of the area (first area) of the peripheral surface of the photosensitive drum 1, which has been subjected to the process for charging the toner particles thereon with the first transfer bias. With the application of this second transfer bias, most of the recharged toner particles on the peripheral surface of the photosensitive drum 1 can be transferred onto the intermediary transfer belt 51.

(3) The reversely charged toner particles on the intermediary transfer belt are removed.

After the positively charged toner particles are transferred onto the intermediary transfer belt 51, they are conveyed further by the rotation of the intermediary transfer belt 51 while coming into contact with the second transfer roller 57 (which is on the inward side of the loop that the intermediary transfer belt 51 forms) shown in FIG. 1. It is desired that during this conveyance of the positively charge toner particles, in order to prevent the positively charged toner particles from adhering to the peripheral surface of the secondary transfer roller 57, a bias which is the same in polarity as the positively charged toner particles is applied to the secondary transfer roller 57, or the second transfer roller 57 is grounded. Further, the secondary transfer roller 57 may be separated from the intermediary transfer belt 51. Then, the positively charged toner particles on the intermediary transfer belt 51 are further conveyed to the intermediary transfer belt cleaner 60, by which they are removed.

As described above, in this embodiment, the undercharged toner particles which cause the photosensitive drum 1 to be unsatisfactorily charged, and/or unsatisfactorily exposed, and/or weld themselves to the photosensitive drum 1, are removed from the peripheral surface of the photosensitive drum 1 after they are recharged by the transfer roller 53. Therefore, a satisfactory image is reliably formed regardless of the length of an image forming operation.

As for the timing with which the cleaner-less image forming apparatus in this embodiment is to be operated in the cleaning mode, the image forming apparatus may be operated in the cleaning mode at least once every preset number of copies, every preset length of time the image forming apparatus is operated, etc. Incidentally, the chargeability of toner is seriously affected by the ambient humidity. Therefore, the above-mentioned timing may be changed according to the ambient humidity in order to more efficiently remove the undercharged toner particles.

Further, in this embodiment, the photosensitive drum 1 and intermediary transfer belt 51 are differentiated in peripheral velocity by 1-3% in Step (2) in the cleaning mode, in which the toner particles on the photosensitive drum 1 are transferred onto the intermediary transfer belt 51. This difference in peripheral velocity between the photosensitive drum 1 and intermediary transfer belt 51 increases the efficiency with which the recharged toner particles are transferred onto the intermediary transfer belt 51.

Further, the above-mentioned members used in this embodiment do not need to be limited to those physical properties described above, and the values to which the above-described biases are to be set do not need to be limited to those given above. That is, they are optional, and may be selected or set according to circumstances. The choices of the charging means and transferring means do not need to be limited to a roller of the contact type. That is, the present invention is also compatible with a charging means based on corona discharge. Further, in this embodiment, the cleaner-less image forming apparatus was provided with the pair of toner charge controlling means, which were in contact with the peripheral surface of the photosensitive drum 1. However, this embodiment is also compatible with a cleaner-less image forming apparatus which does not have a toner charge controlling means. That is, the toner charge can be controlled using the transferring means.

Further, this embodiment was described with reference to the image forming apparatus of the intermediary transfer type. However, the present invention is also applicable to an image forming apparatus of the direct transfer type, that is, an image forming apparatus which uses a recording medium conveying member, such as a recording medium conveyance belt or a transfer drum, for bearing and conveying recording medium.

Embodiment 2

Like the primary object of the first embodiment, the primary object of this embodiment is also to remove the undercharged toner particles which remain stuck on the peripheral surface of the photosensitive drum 1. However, this embodiment is different from the first one in the polarity to which toner particles are recharged using the transfer 53. That is, in the first embodiment, the undercharged or reversely charged toner particles were charged to the positive polarity, that is, the polarity opposite to the normal toner polarity, and then, are collected in the transfer area d, whereas in this embodiment, the undercharged toner particles are charged to the negative polarity, that is, the normal toner polarity, using the primary transfer roller 53, and are collected by the developing apparatus 4.

The structure of the image forming apparatus in this embodiment is the same as that in the first embodiment. Therefore, it will not be described. Hereafter, the cleaning mode in this embodiment, which characterizes this embodiment, will be described in detail. In the cleaning mode in this embodiment, the undercharged toner particles are recharged, and then, are collected by the developing apparatus 4.

(1) The undercharged toner particles are negatively charged using a third transfer contrast which is opposite in direction from that effected for the normal image formation process, and is greater than that effected for the normal image formation process.

Figure 19:
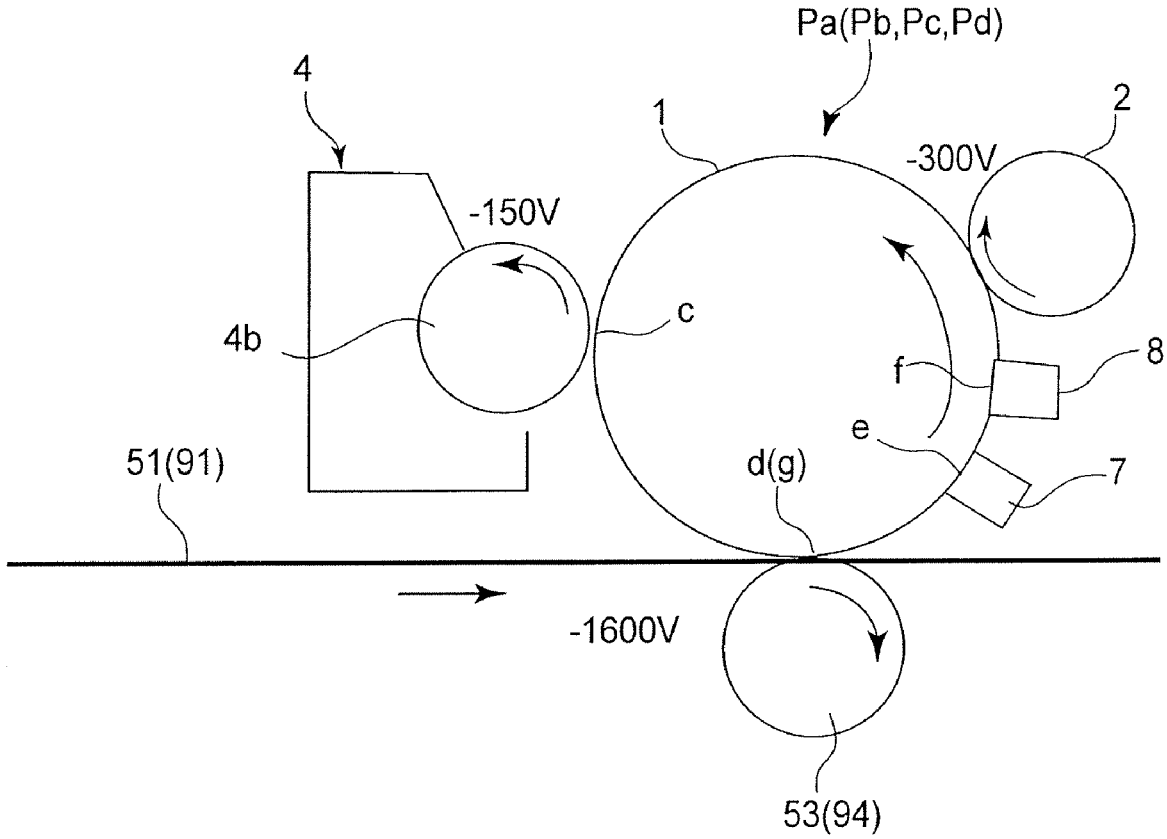
FIG. 19 is a schematic drawing of the process unit in the second embodiment of the present invention, showing what occur to the photosensitive drum and its adjacencies when the image forming apparatus is in the cleaning mode.
Figure 20:
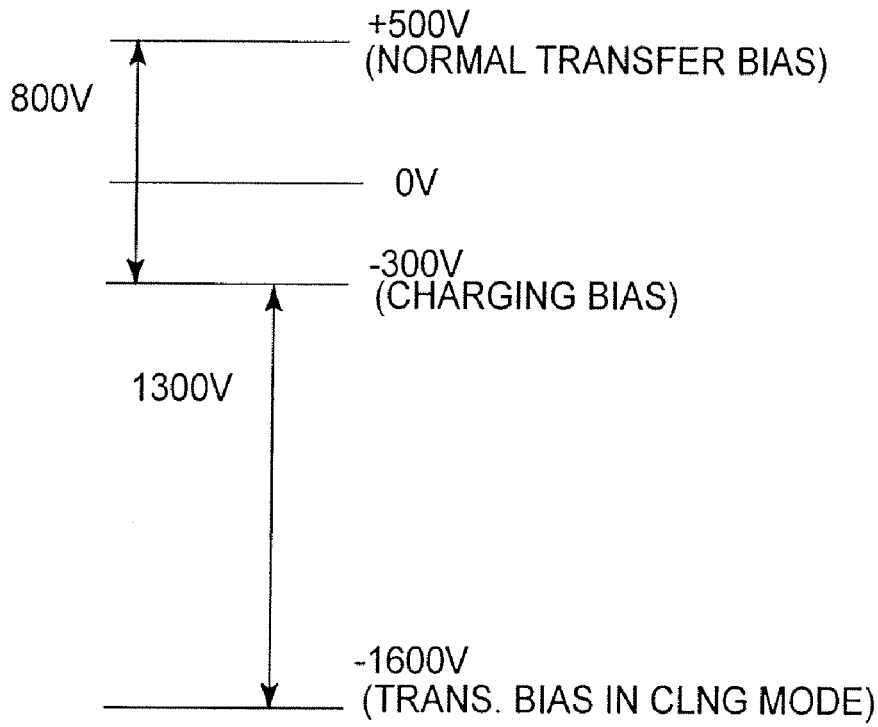
FIG. 20 is a schematic drawing showing the contrast voltage (bias) in the second embodiment of the present invention.
Figure 21:
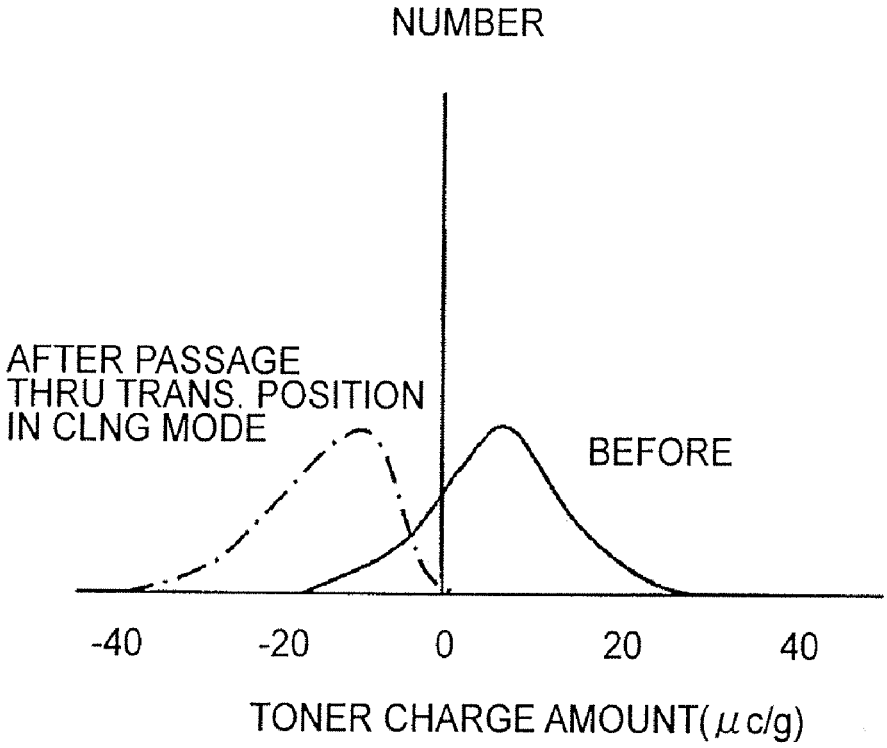
FIG. 21 is a graph showing the difference in the particle distribution of the transfer residual toner, in terms of the amount of electric charge, before and after the transfer residual toner is moved through the transfer area when the image forming apparatus is in the cleaning mode.

Referring to FIG. 19, which shows the general structure of the process unit Pa (Pb, Pc, and Pd) in this embodiment, the operation of the image forming apparatus in this embodiment, in the cleaning mode, will be described. First, the peripheral surface of the photosensitive drum 1 is uniformly charged to −300 V by the charge roller 2. The potential level to which the peripheral surface of the photosensitive drum 1 is charged in this step is optional. In this embodiment, however, the transfer contrast in the transfer area d can be increased by reducing, in absolute value, the potential level to which the peripheral surface of the photosensitive drum 1 is charged. While the charged area of the peripheral surface of the photosensitive drum 1 moves through the exposing area b, it is not irradiated with the beam of laser light. Further, while the charged area moves through the development area c (development location), −150 V of DC voltage is applied as development bias to the development sleeve 4*b*. This bias is for preventing the magnetic carrier from adhering to the peripheral surface of the photosensitive drum 1. In this step, the development sleeve 4*b* does not need to be rotated. Next, while the charged area moves through the transfer area d, −1,600 V of DC voltage is applied as the third transfer bias to the transfer roller 53. Referring to FIG. 20, the amount by which the transfer current flows is determined by the contrast voltage (transfer contrast), which is the difference between the surface potential level of the photosensitive drum 1 and transfer bias. In this embodiment, the transfer contrast in the cleaning mode is 1,300 V (=(−300−(−1600)). The amount, in absolute value, of the electric current which flows through the primary transfer roller 53 when the image forming operation is operated in the cleaning mode is 15 μA. In comparison, the transfer contrast in the normal image formation mode is 800 V (=200−(−600)). The amount, in absolute value, of the electric current which flows through the primary transfer roller 53 when the image forming operation is operated in the normal image formation mode is 9 μA.

Therefore, when the image forming apparatus is operated in the cleaning mode, electrical discharge occurs in the adjacencies of the transfer area d. Further, the transfer bias applied in the cleaning mode is opposite in polarity from the normal transfer bias. Therefore, not only can this electrical discharge cause the positively charged toner particles on the photosensitive drum 1 to transfer onto the intermediary transfer belt 51, but also, it can charge the undercharged toner particles on the peripheral surface of the photosensitive drum 1 to the negative polarity. Referring to FIG. 20, which shows the distributions of the toner particles, in terms of amount of charge, on the peripheral surface of the photosensitive drum 1, before and after the undercharged and positively charged toner particles on the peripheral surface of the photosensitive drum 1 were moved through the transfer area d, it is evident that while the undercharged or positively charged toner particles are moved through the transfer area d, they were negatively charged virtually in entirety.

Most of the undercharged toner particles having accumulated on the peripheral surface of the photosensitive drum 1 can be recharged by carrying out the above-described process for charging the toner particles on the peripheral surface of the photosensitive drum 1 by applying the third transfer bias to the transfer roller 53, for a length of time equivalent to no less than one full rotation of the photosensitive drum 1.

(2) The negatively charged toner particles are collected from the photosensitive drum 1 into the developing apparatus 4.

Figure 22:
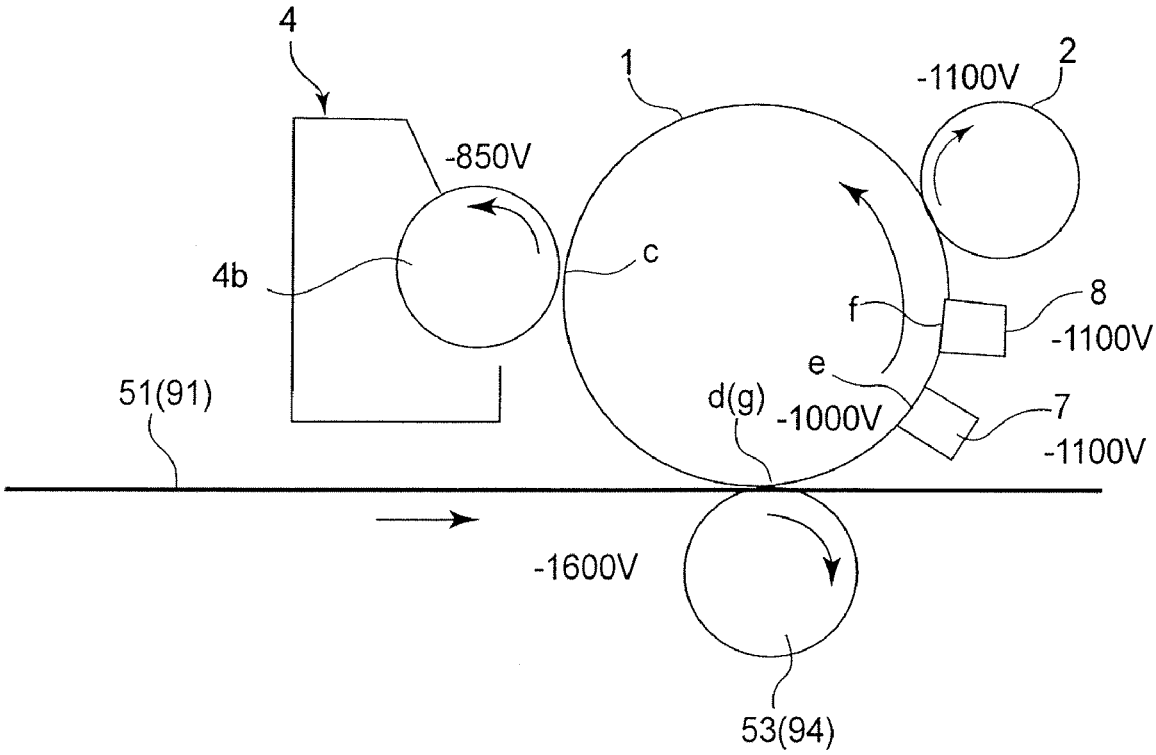
FIG. 22 is a schematic drawing of the process unit, showing what occurs to the photosensitive member and its adjacencies while the negatively charged toner particles are conveyed to the development area.

More specifically, the negatively charged toner particles, which were effected by the above-described process, are conveyed to the development area c by the subsequent rotation of the photosensitive drum 1. Next, referring to FIG. 22, what occurs to various portions of the process unit Pa (Pb, Pc, and Pd) while this process is carried out will be described. As a given area of the peripheral surface of the photosensitive drum 1 moves through the transfer area d, it is charged by the transfer contrast. In this embodiment, the transfer bias was −1,600 V. After the given area was moved through the transfer area d, its surface potential was −1,000 V.

At this point in operation, most of the toner particles on the peripheral surface of the photosensitive drum 1 are negatively charged. Therefore, in order to prevent the toner particles from adhering to the various members of the process unit Pa due to the presence of the difference in potential level between the photosensitive drum 1 and the various members, the various members must be controlled in potential while the toner particles are moved through the adjacencies of the members. In this embodiment, therefore, −1,100 V is applied to the first toner charge controlling means 7, second toner charge controlling means 8, and charge roller 2, which are on the downstream side of the transfer area d. Thus, most of the positively charged toner particles reach the development area c, without adhering to the various members, by being conveyed by the subsequent rotation of the photosensitive drum 1.

After the negatively charged toner particles on the photosensitive drum 1 reach the development area c, they are used during the normal image formation process. That is, by the application of the fog removal bias to the development sleeve 4*b*, they are collected into the developing apparatus 4, like the negatively charged transfer residual toner particles. Here, the fog removal bias means the difference Vback between the DC voltage applied to the developing apparatus 4 and the potential level of the peripheral surface of the photosensitive drum 1. In this embodiment, the development bias was set to −800 V.

Incidentally, for the purpose of collecting the toner particles which are not collected by the developing apparatus 4, it is effective to apply a fourth transfer bias, which is positive in polarity, to the primary transfer roller 53.

As described above, according to this embodiment, the undercharged toner particles which cause the photosensitive drum 1 to be unsatisfactorily charged, and/or unsatisfactorily exposed, and/or weld themselves to the photosensitive drum 1, are recharged by the transfer roller 53, and then, are collected into the developing apparatus 4. Therefore, a satisfactory image is reliably formed regardless of the length of an image forming operation.

The structural design in this embodiment is inferior to that in the first embodiment, in that the high voltage power source for image transfer in this embodiment has to be substantially larger in capacity than that in the first embodiment. However, the structural design in this embodiment makes it possible to collect the toner particles having accumulated on the peripheral surface of the photosensitive drum 1, into the developing apparatus 4, making it possible to more efficiently use the toner than that in the first embodiment. In this embodiment, however, it is desired that in order to prevent the toner particles having accumulated on the peripheral surface of the photosensitive drum 1, from deteriorating (separation of external additives from toner particles, for example), some measures (such as controlling difference in peripheral velocity between photosensitive drum 1 and intermediary transfer belt 51, in transfer area d) are taken to prevent the toner particles on the peripheral surface of the photosensitive drum 1 from sustaining mechanical damages.

Embodiment 3

The image forming apparatus in this embodiment has a recording medium conveyance belt for bearing and conveying recording medium. Next, referring to FIG. 23 which shows the image forming apparatus in this embodiment, the structure and operation of the image forming apparatus in this embodiment will be described. The image forming apparatus in this embodiment has four process units Pa, Pb, Pc, and Pd which form yellow, magenta, cyan, and black images (images formed of toner), respectively. The four toner images, which are different in color and formed by the process units Pa, Pb, Pc, and Pd, respectively, are sequentially transferred (primary transfer) onto a recording medium P, which is borne, and being conveyed by, an intermediary transfer belt 91 as a recording medium conveying member, in the primary transfer area g. The process units Pa, Pb, Pc, and Pd in this embodiment are identical in structure as those in the first embodiment. Therefore, the components of the process units in this embodiment, which are identical in structure and function to the counterparts in the first embodiment, will be given the same referential symbols as those given to the counterparts in the first embodiment, and will not be described.

Figure 23:
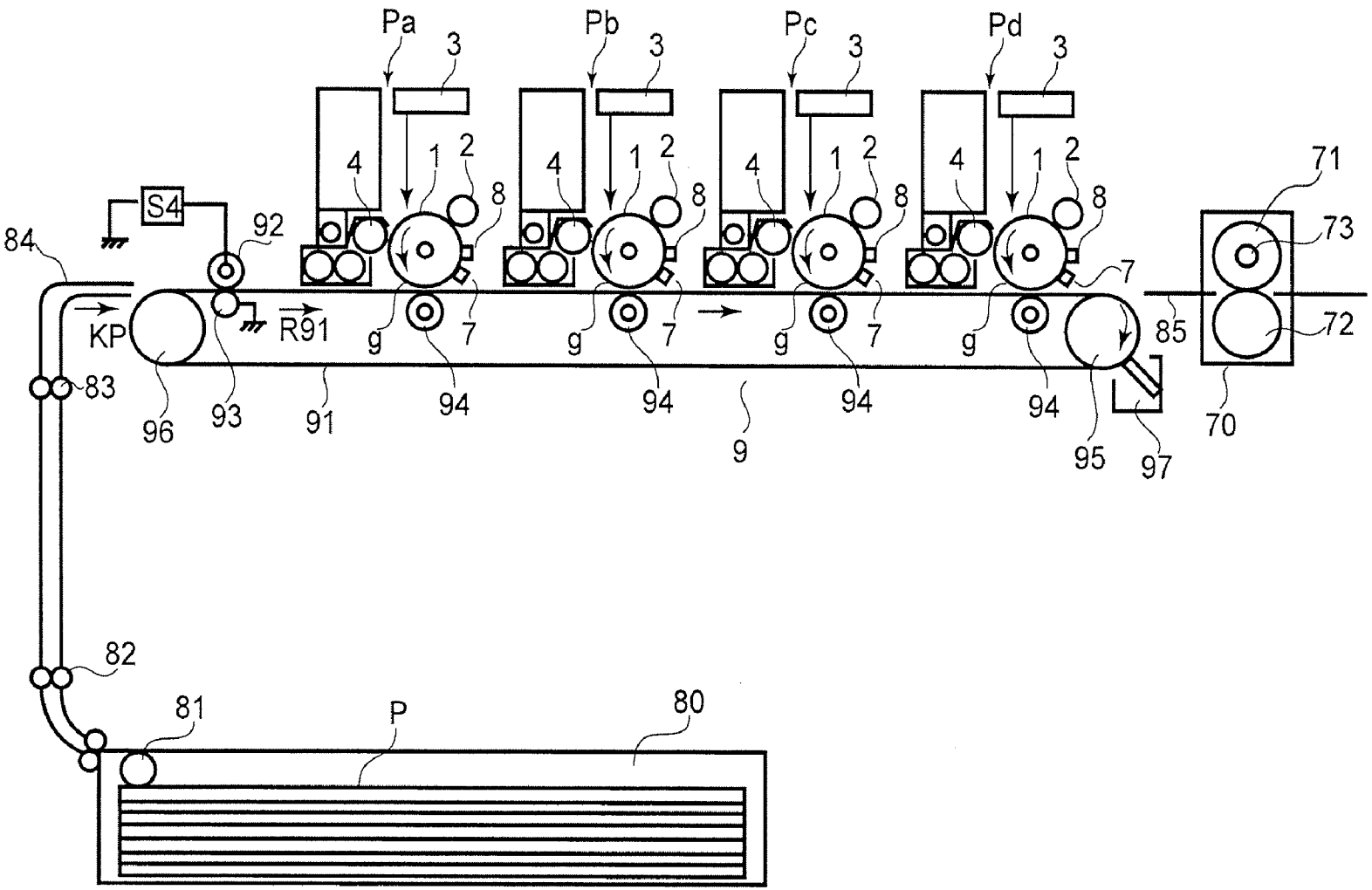
FIG. 23 is a schematic drawing of the image forming apparatus in the third and fourth preferred embodiments of the present invention, showing the general structure thereof.

Next, a recording medium conveyance unit 9 will be described. Referring to FIG. 23, the recording medium conveyance unit 9 is disposed so that it is below each of the photosensitive drums 1 of the process units Pa, Pb, Pc, and Pd. The recording medium conveyance unit 9 has a recording medium conveyance belt 91, an adhesion roller 92, a belt backing roller 93 (roller which opposes adhesion roller 92 with recording medium conveyance belt pinched between it and adhesion roller 92), four primary transfer rollers 94, a recording medium conveyance belt driving roller 95, a tension roller 96, and a recording medium conveyance belt cleaner 97.

The recording medium conveyance belt 91 is made by forming dielectric resin into an endless belt. In this embodiment, a sheet of PI resin, which is $10^{12}$ Ω·cm in volume resistivity (measured with the use of a probe in compliance with JIS-K9611, while applying 1,000 V for 60 seconds, at 23° C. in temperature and 60% in RH), and 90 μm in thickness t, was used as the material for the recording medium conveyance belt 91. However, the material for the recording medium conveyance belt 91 does not need to be limited to the above-mentioned one. That is, any substance may be used as the material for the recording medium conveyance belt 91, as long as the volume resistivity of the substance is in a range of $10^{12}$-$10^{14}$ Ω·cm when 1,000 V is applied. The thickness, etc., of the material does not matter.

As the transfer roller 94 (transferring member), a roller which is identical to the primary transfer roller 53 of the image forming apparatus in the first embodiment is used. To each transfer roller 94, +1,700 V of transfer bias is applied from an electric power source S3 as will be described later. As the transfer bias is applied to the transfer roller 94, the toner image on the photosensitive drum 1 is transferred onto the recording medium P borne on the recording medium conveyance belt 91, in the transfer area g. Incidentally, the transfer bias which the electric power source S3 applies to the transfer roller 94 is controlled by a controlling means 98.

A fixing apparatus 70 as a fixing means in this embodiment is identical in structure to the fixing apparatus 70 in the first embodiment. Therefore, the components of the fixing apparatus 70 in this embodiment, which are the same in structure and function to the counterparts in the first embodiment will be given the same referential symbols as those given to the counterparts, and will not be described.

The image formation (image forming operation) by the above-described image forming apparatus is as follows: Multiple toner images different in color are sequentially formed on the photosensitive drums 1, one for one, and are sequentially transferred onto the recording medium P, which is borne on the transfer medium conveyance belt 91, and is being conveyed by the transfer medium conveyance belt 91.

Meanwhile the recording medium P in the sheet feeder cassette 80 is picked out of the sheet feeder cassette 80 by a pickup roller 81, and is fed into the main assembly of the image forming apparatus by the pickup roller 81. Then, the recording medium P is delivered to a pair of conveyer rollers 82, and then, to a pair of conveyer rollers 83. Then, the recording medium P is further conveyed along a pre-transfer sheet conveyance guide 84, in the direction indicated by an arrow mark Kp. To the adhesion roller 92, −2,300 V of voltage is applied from an electric power source S4. Thus, the recording medium P is electrostatically adhered to the recording medium conveyance belt 91 by the function of the electric field generated between the adhesion roller 92, and the belt backing roller 93, which is grounded. The adhesion roller 92 is a rubber roller, and the belt backing roller 93 is a metallic roller.

After the toner images are transferred onto the recording medium P, the recording medium P is separated from the transfer medium conveyance belt 91, and conveyed further to the fixing apparatus 70. Then, the recording medium P is conveyed between the fixation roller 71 and pressure roller 72 of the fixing apparatus 70. While the recording medium P is conveyed between the two rollers 71 and 72, the recording medium P and the toner images thereon are subjected to the roughly constant heat and pressure applied thereto from the top and bottom sides of the recording medium P. Therefore, the toner images on the recording medium are welded to the surface of the recording medium P, ending the image forming operation for yielding a single one-sided full-color copy (formed of four primary color) of the intended image. The toner particles having adhered to the recording medium conveyance belt 91 are collected by the recording medium conveyance belt cleaner 97.

The process units Pa, Pb, Pc, and Pd of the image forming apparatus in this embodiment also use the cleaner-less cleaning system. The structure of the cleaner-less cleaning system is the same as that of the image forming apparatus in the first embodiment. Therefore, the components of the cleaner-less cleaning system of the image forming apparatus in this embodiment, which are identical in structure and function to the counterparts in the first embodiment will be given the same referential symbols as those given to the counterparts in the first embodiment, and will not be described.

Also in this embodiment, some of the undercharged toner particles and reversely charged toner particles remaining stuck on the photosensitive drum 1 are not collected by the developing apparatus 4, and remain stuck to the peripheral surface of the photosensitive drum 1 through the subsequent rotations of the photosensitive drum 1.

Therefore, the image forming apparatus in this embodiment is also provided with two structural arrangements dedicated to the control of the undercharged toner particles and reversely charged toner particles, as is the image forming apparatus in the first embodiment.

(A) Structural Arrangement for Transferring Means

In order to reduce the amount by which the undercharged toner particles and reversely charged toner particles are effected, the image forming apparatus in this embodiment is structured to reduce the electrical discharge which occurs in the transfer area g.

It was found that also in the case of the image forming apparatus in this embodiment, there was a correlation between the amount of the undercharged toner particles and reversely charged toner particles, and the transfer bias setting.

In this embodiment, however, the transfer bias was set to +1,700 V in consideration of the amount of the undercharged toner particles and reversely charged toner particles, and the transfer efficiency. Even though the transfer bias was set to +1,700 V, a small amount of reversely charged toner particles, that is, the positively charged toner particles, was present in the transfer residual toner, as it was in the transfer residual toner in the image forming apparatus in the first embodiment.

(B) Toner Charge Controlling Means

Therefore, also in this embodiment, in order to make all the toner particles in the transfer residual toner normally charged, that is, negatively charged, as they were in the first embodiment, the image forming apparatus is provided with a first toner (developer) charge controlling means 7 and a second toner (developer) charge controlling means 8, as shown in FIG. 2.

After all the toner particles in the transfer residual toner are charged to the negative polarity, that is, the normal toner polarity, they are conveyed to the development area b, without adhering to the charge roller 2, which is on the downstream side of the toner charge controlling means 7 and 8, and to which negative voltage is being applied. Then, the transfer residual toner is collected by the developing apparatus 4, and reused.

However, some toner particles in the transfer residual toner move through the toner charge controlling means 7 and 8, without being recharged by the toner (developer) charge controlling means 7 and 8. Therefore, they are not likely to be collected by the developing apparatus 4. Thus, these undercharged toner particles and reversely charged toner particles accumulate on the peripheral surface of the photosensitive drum 1, and move with the peripheral surface of the photosensitive drum 1.

As stated in the description of the first embodiment, the reversely charge toner particles could be removed by applying such a bias that is opposite in polarity to the normal transfer bias, to the transfer roller 94. However, this method could not entirely remove the undercharged toner particles.

In this embodiment, therefore, the undercharged toner particles are removed after they are recharged using the transfer roller 94. That is, this method recharges the undercharged toner particles to make them collectable by the transfer electric field.

Next, the cleaning mode in this embodiment, which characterizes this embodiment, will be described in detail. This cleaning mode is for removing the undercharged toner particles.

(1) The cleaning mode in this embodiment is carried out while the image forming apparatus is not used for a normal image forming operation, and therefore, no recording medium P is in the transfer area e.

In the cleaning mode in this embodiment, the undercharged toner particles are charged to the polarity, which is opposite to the normal toner polarity, by charging such a first transfer bias that makes the amount, in absolute value, of the electric current which flows through the transfer area g in the cleaning mode greater than the amount, in absolute value, of the electric current which flows through the transfer area g during the normal image formation.

Next, referring to FIG. 13, which shows the general structure of the process unit Pa (Pb, Pc, and Pd), the operation of the image forming apparatus in the cleaning mode in this embodiment will be described. First, the peripheral surface of the photosensitive drum 1 is uniformly charged to −600 V by the charge roller 2. The potential level to which the peripheral surface of the photosensitive drum 1 is charged in this step is optional; increasing, in absolute value, the potential level to which the peripheral surface of the photosensitive drum 1 is to be charged can increase the transfer contrast (which will be described later) in the transfer area g. Also in the cleaning mode in this embodiment, the uniformly charged area of the peripheral surface of the photosensitive drum 1 is not irradiated with a beam of laser light, while the charged area moves through the exposing area b. Further, while the uniformly charged area moves through the development area c, −450 V of DC voltage is applied as development bias to the development sleeve 4*b*. This bias is for preventing the magnetic carrier from adhering to the peripheral surface of the photosensitive drum 1. In this step, the development sleeve 4*b* does not need to be rotated. Next, while the charged area moves through the transfer area d, +1,200 V of DC voltage is applied as the first transfer bias to the transfer roller 53.

The amount by which the transfer current flows is determined by the contrast voltage (transfer contrast), which is the difference between the surface potential level of the photosensitive drum 1 and transfer bias, and also, by whether or not the recording medium P is in the transfer area g.

In this embodiment, no recording medium is in the transfer area g while the image forming apparatus is operated in the cleaning mode, and the transfer contrast is set to 1,800 V (=1,200−(−600)). The amount of the electric current which flows through the primary transfer roller 94 when the image forming operation is operated in the cleaning mode is 15 μA in absolute value. On the other hand, during the normal image forming operation, there is the recording medium P in the transfer area g, and the transfer contrast is set to 2,300 V (=1,700−(−600)). The amount of the electric current which flows through the primary transfer roller 94 when the image forming operation is operated in the normal image formation mode is 9 μA in absolute value.

Therefore, when the image forming apparatus is operated in the cleaning mode, electrical discharge occurs in the adjacencies of the transfer area g, and this electrical discharge charges the undercharged toner particles on the peripheral surface of the photosensitive drum 1 to the positive polarity.

Thus, when the cleaner-less image forming apparatus in this embodiment is operated in the above-described cleaning mode, most of the undercharged toner particles having accumulated on the peripheral surface of the photosensitive drum 1 can be recharged by carrying out the above-described process for charging the toner particles on the peripheral surface of the photosensitive drum 1, for a length of time equivalent to no less than one full rotation of the photosensitive drum 1.

(2) The positively charged toner particles are transferred from the photosensitive drum 1 onto the recording medium conveyance belt 91, by flowing transfer current by applying a second transfer bias, which is opposite in direction from the first transfer bias, which is applied for the normal image formation.

More specifically, the positively charged toner particles, which were affected by the above-described process, are conveyed, for the second time, to the transfer area g by the subsequent rotation of the photosensitive drum 1. What occur to various portions of the process unit Pa (Pb, Pc, and Pd) while this process is carried out will be described referring to FIG. 16. As a given area (first area) of the peripheral surface of the photosensitive drum 1 moves through the transfer area g, it is charged by the transfer contrast. Therefore, the potential level of area (first area) of the peripheral surface of the photosensitive drum 1 which has just moved through the transfer area g, is closer to the potential level of the transfer bias than it is to −600 V, which was its potential level before it was moved through the contact area g. In this embodiment, +1,200 V of second transfer bias was applied in the cleaning mode. After the above-mentioned area was moved through the contact area g, its potential level was −50 V.

Most of the toner particles on the peripheral surface of the photosensitive drum 1 are positively charged. Therefore, in order to prevent the positively charged toner particles from adhering to the various members of the process unit Pa due to the presence of the difference in potential level between the peripheral surface of the photosensitive drum 1 and the various members, the members must be controlled in potential while the toner particles move through the adjacencies of the members. Referring to FIG. 16, in this embodiment, therefore, +400 V is applied to the first toner charge controlling means 7, which is on the downstream side of the contact area g, but, no bias is applied to the second toner charge controlling means 8, charge roller 2, and development sleeve 4*b*, as in the first embodiment. Thus, as the positively charged toner particles on the peripheral surface of the photosensitive drum 1 are conveyed by the rotation of the photosensitive drum 1 through the adjacencies of the various members of the process unit Pa, most of the positively charged toner particles reach the contact area g, for the second time, without adhering to the above-mentioned various members. For the purpose of preventing, as described above, the positively charged toner particles on a given area of the peripheral surface of the photosensitive drum 1 from adhering to the various members of the process unit Pa, due to the presence of the difference in potential level between the area of the peripheral surface of the photosensitive drum 1 and the various members, while the area is moved through the adjacencies of the various members, it is desired that after the above-mentioned area of the peripheral surface of the photosensitive drum 1 is moved through the contact area g, the area is the same (negative) in polarity as the charge bias applied to the charge roller 2 during the normal image forming operation. If the potential of a given area of the peripheral surface of the photosensitive drum 1 is positive in polarity after it is moved through the contact area g, positive bias must be applied to the charge roller 2 and development sleeve 4*b* to prevent the positively charged toner particles on the area from adhering to the charge roller 2 and development sleeve 4*b*. These biases are not required for the normal image formation. Therefore, the application of these biases requires the addition or modification of the high voltage power sources, which increases the cost for the high voltage power sources.

As described above, the positively charge toner particles on the peripheral surface of the photosensitive drum 1 are conveyed to the contact area g and are moved through the contact area g, by the rotation of the photosensitive drum 1. While these positively charged toner particles are moved through the transfer area g, −1,250 V is applied as the second transfer bias, which is opposite in polarity to the normal transfer bias, from the transfer roller 94, providing 1,300 V of transfer contrast. Therefore, the positively charged toner particles on the photosensitive drum 1 are transferred onto the recording medium conveyance belt 91.

As described above, the second transfer bias, which is opposite in polarity to the normal transfer bias, is applied from the transfer roller 94 to the entirety of the area (first area) of the peripheral surface of the photosensitive drum 1, which has been subjected to the process for charging the toner particles thereon with the first transfer bias. With the application of this second transfer bias, most of the recharged toner particles on the peripheral surface of the photosensitive drum 1 can be transferred onto the recording medium conveyance belt 91.

(3) The reversely charged toner particles on the recording medium conveyance belt are removed.

After the positively charged toner particles are transferred onto the recording medium conveyance belt 91, they are conveyed to the recording medium conveyance belt cleaner 97, by which they are removed.

As described above, in this embodiment, the undercharged toner particles which cause the photosensitive drum 1 to be unsatisfactorily charged, and/or unsatisfactorily exposed, and/or weld themselves to the photosensitive drum 1, are removed from the peripheral surface of the photosensitive drum 1 after they are recharged using the transfer roller 94. Therefore, a satisfactory image is reliably formed regardless of the length of an image forming operation.

As for the timing with which the cleaner-less image forming apparatus in this embodiment is to be operated in the cleaning mode, the image forming apparatus may be operated in the cleaning mode at least once every preset number of copies, every preset length of time the image forming apparatus is operated, etc. Incidentally, the chargeability of toner is seriously affected by the ambient humidity. Therefore, the above-mentioned timing may be changed according to the ambient humidity in order to more efficiently remove the undercharged toner particles.

Further, in the cleaning mode in this embodiment, the photosensitive drum 1 and recording medium conveyance belt 91 are differentiated in peripheral velocity by 1-3% in Step (2), in which the toner particles on the photosensitive drum 1 are transferred onto the recording medium conveyance belt 91. This difference in peripheral velocity between the photosensitive drum 1 and recording medium conveyance belt 91 increases the efficiency with which the recharged toner particles are transferred onto the recording medium conveyance belt 91.

Further, the above-mentioned members used in this embodiment do not need to be limited in properties to those described above, and the values to which the above-described biases are to be set do not need to be limited to those given above. That is, they are optional, and may be selected, or set, according to circumstances. The choices of the charging means and transferring means do not need to be limited to a roller of the contact type. That is, the present invention is also compatible with a charging means based on corona discharge. Further, in this embodiment, the cleaner-less image forming apparatus was provided with the pair of toner charge controlling means, which were in contact with the peripheral surface of the photosensitive drum 1. However, this embodiment is also compatible with a cleaner-less image forming apparatus which does not have a toner charge controlling means. That is, the toner charge can be controlled using the transferring means.

Embodiment 4

This embodiment is primarily intended to remove the undercharged toner particles which remain stuck on the peripheral surface of the photosensitive drum 1 in the image forming apparatus employing the recording medium conveyance belt 91, as was the third embodiment. However, this embodiment is different from the third one in the polarity to which the undercharged toner particles are charged using the transfer roller 94. That is, in the third embodiment, the image forming apparatus was structured so that the undercharged toner particles were collected in the contact area g after they are charged to the positive polarity, that is, the polarity opposite to the normal toner polarity, whereas the image forming apparatus in this embodiment is structured so that the undercharged toner particles are first charged to the negative polarity, that is, the normal toner polarity, using the transfer roller 94, and then, are collected by the developing apparatus 4.

The structure of the image forming apparatus in this embodiment is the same as that in the first embodiment. Therefore, it will not be described. Hereafter, the cleaning mode in this embodiment, which characterizes this embodiment, will be described in detail. In the cleaning mode in this embodiment, the undercharged toner particles are recharged, and then, are collected by the developing apparatus 4.

(1) A transfer bias which is opposite in polarity to the transfer bias applied during a normal image forming operation, is applied to the transfer roller 94.

In the cleaning mode in this embodiment, the undercharged toner particles are negatively charged by setting the transfer bias so that the amount of electric current which flows through the transfer roller 94 in the cleaning mode is greater in absolute value than the amount of electric current that flows through the transfer roller 94 during a normal image forming operation.

Referring to FIG. 19, which shows the general structure of the process unit Pa (Pb, Pc, and Pd) in this embodiment, the operation of the image forming apparatus in the cleaning mode in this embodiment will be described. First, the peripheral surface of the photosensitive drum 1 is uniformly charged to −300 V by the charge roller 2. The potential level to which the peripheral surface of the photosensitive drum 1 is charged in this step is optional. In this embodiment, however, the transfer contrast in the contact area g can be increased by reducing in absolute value the potential level to which the peripheral surface of the photosensitive drum 1 is charged. While the charged area of the peripheral surface of the photosensitive drum 1 moves through the exposing area b, it is not irradiated with the beam of laser light. Further, while the charged area moves through the development area c (development position), −150 V of DC voltage is applied as development bias to the development sleeve 4*b*. This bias is for preventing the magnetic carrier from adhering to the peripheral surface of the photosensitive drum 1. In this step, the development sleeve 4*b* does not need to be rotated. Next, while the charged area moves through the transfer area g, −2,100 V of DC voltage is applied as the third transfer bias to the transfer roller 94.

The amount by which the transfer current flows through the transfer roller 94 is determined by the contrast voltage (transfer contrast), which is the difference between the surface potential level of the photosensitive drum 1 and transfer bias.

In this embodiment, while the image forming apparatus is operated in the cleaning mode, recording medium P is not in the transfer area g, and the transfer contrast is set to 1,800 V (=(−300)−(−2,100)). Therefore, when the image forming apparatus is operated in the cleaning mode, 15 μm, in terms of absolute value, of electric current flows through the transfer roller 94.

On the other hand, when the image forming apparatus in this embodiment is operated in the normal mode, the recording medium P is in the transfer area g, and the transfer contrast is set to 2,300 V (=1,700−(−600)). Thus, during the image formation, 9 μm, in absolute value, of electric current flows through the transfer roller 94.

Thus, electrical discharge occurs in the adjacencies of the transfer area g, charging the undercharged toner particles on the peripheral surface of the photosensitive drum 1 to the negative polarity.

Most of the undercharged toner particles having accumulated on the peripheral surface of the photosensitive drum 1 can be recharged by carrying out the above-described process for charging the toner particles on the peripheral surface of the photosensitive drum 1 by applying the third transfer bias to the transfer roller 94, for a length of time equivalent to no less than one full rotation (second area) of the photosensitive drum 1.

(2) The negatively charged toner particles are collected from the photosensitive drum 1 into the developing apparatus 4.

More specifically, the negatively charged toner particles on the peripheral surface of the photosensitive drum 1, which were affected by the above-described process, are conveyed to the development area c by the subsequent rotation of the photosensitive drum 1. What occurs to various portions of the process unit Pa (Pb, Pc, and Pd) while this process is carried out will be described referring to FIG. 22. As a given area of the peripheral surface of the photosensitive drum 1 moves through the transfer area g, it is charged by the transfer contrast. In this embodiment, the transfer bias was −2,100 V, and after the given area was moved through the transfer area g, its surface potential was −1,000 V.

At this point in operation, most of the toner particles on the peripheral surface of the photosensitive drum 1 are negatively charged. Therefore, in order to prevent the toner particles from adhering to the various members of the process unit Pa due to the presence of the difference in potential level between the peripheral surface of the photosensitive drum 1 and the various members, the various members must be controlled in potential while the toner particles are moved through the adjacencies of the members. In this embodiment, therefore, −1,100 V is applied to the first toner charge controlling means 7, second toner charge controlling means 8, and charge roller 2, which are on the downstream side of the transfer area g. Thus, most of the negatively charged toner particles reach the development area c without adhering to the various members.

After the negatively charged toner particles on the photosensitive drum 1 reach the development area c, they are used during a subsequent image forming operation. More specifically, as they reach the development area c, they are collected into the developing apparatus 4 by the application of the fog removal bias to the development sleeve 4*b*, as are the negatively charged transfer residual toner particles. Here, the fog removal bias means the difference Vback between the DC voltage applied to the developing apparatus 4 and the surface potential level of the photosensitive drum 1. In this embodiment, the development bias was set to −850 V.

Further, for the purpose of collecting the toner particles which are not collected by the developing apparatus 4 during the above-described process, it is effective to apply a fourth transfer bias, which is positive in polarity, to the primary transfer roller 94.

As described above, according to this embodiment, the undercharged toner particles which cause the photosensitive drum 1 to be unsatisfactorily charged, and/or unsatisfactorily exposed, and/or weld themselves to the photosensitive drum 1, can be recharged by the transfer roller 94, and then, can be collected into the developing apparatus 4. Therefore, a satisfactory image can be reliably formed regardless of the duration of an image forming operation.

The structural design in this embodiment is inferior to that in the first embodiment, in that the high voltage transfer power source in this embodiment needs to be substantially larger in capacity than that in the first embodiment. However, the structural design in this embodiment makes it possible to collect the toner particles having accumulated on the peripheral surface of the photosensitive drum 1, into the developing apparatus 4, making it possible to more efficiently use the toner than that in the first embodiment. In this embodiment, however, it is desired that in order to prevent the toner particles having accumulated on the peripheral surface of the photosensitive drum 1, from deteriorating (separation of external additives from toner particles, for example), some measures (such as controlling difference, in peripheral velocity in transfer area g, between photosensitive drum 1 and recording medium conveyance belt 91) are taken to prevent the toner particles on the peripheral surface of the photosensitive drum 1 from sustaining mechanical damages.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 351364/2005 filed Dec. 5, 2005 which is hereby incorporated by reference.

What is claimed is:

1. An image forming apparatus comprising:

an image bearing member;

a developing device for developing, into a toner image, an electrostatic latent image formed on said image bearing member with toner charged to a first polarity and for collecting the toner from said image bearing member;

an intermediary transfer member for carrying the toner image;

a primary transfer member for primarily transferring the toner image from said image bearing member onto said intermediary transfer member by applying a voltage of a second polarity which is opposite the first polarity to said primary transfer member;

an electric charge applying member for charging the toner remaining on said image bearing member after the primary transfer of the toner image, by applying a voltage of the first polarity;

transfer means for secondarily transferring the toner image from said intermediary transfer member onto a recording material;

removing means for contacting said intermediary transfer member to remove the toner remaining on said intermediary transfer member after the secondary transfer; and an executing portion for executing a toner collection mode operation for removing the toner transferred onto said intermediary transfer member during a non-image formation period, said toner collection mode operation including (i) a first step of applying, to said primary transfer member, the voltage of the second polarity to cause electrical discharge at least for one full rotation of said image bearing member, and (ii) a second step, continuing from the first step, of applying, to said primary transfer member, the voltage of the first polarity at least for one full rotation of said image bearing member.

2. An apparatus according to claim 1, wherein a moving speed of a surface of said image bearing member and a moving speed of said intermediary transfer member are different from each other in the toner collection mode.

3. An apparatus according to claim 1, wherein the voltage of the second polarity for applying to said primary transfer member during the operation in the toner collection mode is higher than the voltage of the second polarity applied to the primary transfer member during an image formation period.

4. An apparatus according to claim 1, wherein during the operation in the toner collection mode, said developing device is not supplied with a voltage.

5. An apparatus according to claim 1, wherein said charging member is supplied with the voltage of the first polarity during the operation in the toner collection mode.

* * * * *